US008251575B2

(12) United States Patent
Sato et al.

(10) Patent No.: US 8,251,575 B2
(45) Date of Patent: Aug. 28, 2012

(54) ELECTRONIC TIMEPIECE

(75) Inventors: Koichi Sato, Niiza (JP); Takuji Ike, Tokyo (JP); Takayuki Uchida, Tokorozawa (JP)

(73) Assignee: Citizen Watch Co., Ltd., Tokyo (JP)

( * ) Notice: Subject to any disclaimer, the term of this patent is extended or adjusted under 35 U.S.C. 154(b) by 178 days.

(21) Appl. No.: 12/921,056

(22) PCT Filed: Mar. 6, 2009

(86) PCT No.: PCT/JP2009/054318

§ 371 (c)(1),
(2), (4) Date: Sep. 3, 2010

(87) PCT Pub. No.: WO2009/110602

PCT Pub. Date: Sep. 11, 2009

(65) Prior Publication Data

US 2011/0013494 A1 Jan. 20, 2011

(30) Foreign Application Priority Data

Mar. 7, 2008 (JP) ..... 2008-057833

(51) Int. Cl.
*G04B 18/00* (2006.01)

(52) U.S. Cl. ..... 368/200

(58) Field of Classification Search ..... 368/200, 368/157, 76, 80–81, 160, 203–205, 64, 66
See application file for complete search history.

(56) References Cited

U.S. PATENT DOCUMENTS

| | | | | |
|---|---|---|---|---|
| 4,418,307 | A | 11/1983 | Hoffmann et al. | |
| 5,889,734 | A | 3/1999 | Sato | |
| 5,933,392 | A * | 8/1999 | Sato et al. | 368/157 |
| 6,339,306 | B1 * | 1/2002 | Hara | 318/696 |
| 7,701,807 | B2 | 4/2010 | Kitazawa et al. | |
| 7,961,557 | B2 * | 6/2011 | Fujii et al. | 368/80 |
| 2007/0115760 | A1 | 5/2007 | Kitazawa et al. | |

FOREIGN PATENT DOCUMENTS

| | | | |
|---|---|---|---|
| EP | 0027856 | A1 | 5/1981 |
| EP | 1693720 | A1 | 8/2006 |
| GB | 2071882 | A | 9/1981 |
| JP | 2000-075063 | A | 3/2000 |
| JP | 2005-172677 | A | 6/2005 |
| JP | 2006-230090 | A | 8/2006 |
| WO | WO 95/27926 | A1 | 10/1995 |

* cited by examiner

*Primary Examiner* — Edwin A. Leon
(74) *Attorney, Agent, or Firm* — Foley & Lardner LLP

(57) ABSTRACT

An electronic timepiece includes a limiting circuit that is controlled by the rotation detecting circuit and limits output of a locking pulse PL. The electronic timepiece prevents the display of the incorrect current time due to impact, by executing impact detection when rotation is detected, and prevents errant hand operation in a magnetic field by not outputting a locking pulse PL by prohibiting impact detection when non-rotation is detected. The electronic timepiece controls the limiting circuit using a ranking-down storing circuit and if the electronic timepiece employs multi-stage load correction, executes impact detection when regularly occurring non-rotation is detected. Thereby, errant deviation in the display of the current time due to impact is prevented. The electronic timepiece prohibits the impact detection and causes the locking pulse PL not to be output when non-rotation other than those occurring regularly is detected. Thereby, errant hand operation in a magnetic field is prevented.

9 Claims, 26 Drawing Sheets

PRIOR ART

PRIOR ART

ELECTRONIC TIMEPIECE

TECHNICAL FIELD

The present invention relates to an electronic timepiece having a stepper motor.

BACKGROUND ART

In electronic timepieces having large hands (especially, the second hand) to improve visibility, a problem arises in that if the timepiece is dropped or is hit against something, the phase of the rotor errantly shifts and the displayed time becomes incorrect due to the impact. Patent Document 1 discloses a method to cope with the problem, where impact-induced rotor vibration is detected; if it is determined that an impact has occurred, an electric current is immediately and forcibly caused to flow in a coil, applying a braking force to the rotor, whereby the display of an incorrect time due to the impact is prevented. This method will hereinafter be referred to simply as "electromagnetic braking scheme".

The conventional art disclosed in Patent Document 1 will be described briefly with reference to FIGS. 21 and 22. FIG. 21 is a block diagram of a configuration of an example of the conventional art. FIG. 22 is a diagram of a waveform output by an electronic timepiece of the example. In FIG. 21, "1" denotes a stepper motor that is configured by a rotor 10 and a coil 13; "101" denotes a driving pulse generating circuit that generates a driving pulse Pa that drives the stepper motor 1; "102" denotes a locking pulse generating circuit that generates a locking pulse PL to brake and control the rotor 10 when the stepper motor 1 is subjected to an impact; "103" denotes a pulse selecting circuit that selects the driving pulse Pa generated by the driving pulse generating circuit 101 or the locking pulse PL generated by the locking pulse generating circuit 102; "108" denotes a driver circuit that outputs to the coil 13, the pulse selected by the pulse selecting circuit 103; and "104" denotes an impact detecting circuit that detects occurrence of an impact using a counter-electromotive current that is generated in the coil 13 by a vibration of the rotor 10.

Operations of the circuits will be described. As depicted in FIG. 22, the driving pulse Pa that is output from the driving pulse generating circuit 101 at a timing s1 that is at the beginning of a second is output from "O1" of the coil 13 through the pulse selecting circuit 103 and the driver circuit 108 and causes the rotor 10 to rotate by 180 degrees. A given time period during which the vibration of the rotor 10 caused by the driving is presumed to come to an end is provided as a dead time period T1 during which no impact detection is executed and thereafter, the operation moves to that in an impact detection time period T2 during which an impact is detected. During the impact detection time period T2, the impact detecting circuit 104 periodically detects, using an impact detection signal g, a counter electro-motive voltage generated by an impact. When a counter-electromotive voltage is generated by an impact G within the time period of the impact detection time period T2, the impact detecting circuit 104 immediately controls the locking pulse generating circuit 102 and the pulse selecting circuit 103 to output the locking pulse PL, and brakes and controls the rotor 10 using the locking pulse PL output from O1 of the coil 13. After the locking pulse PL is output, the dead time period T1 is provided during which a vibration caused by the locking pulse PL comes to an end. Thereafter, the operation moves to that in the impact detection time period T2 during which an impact is again detected.

The locking pulse PL is output in the same phase (O1) as that of the driving pulse Pa. Usually, the rotor 10 is rotated by 180 degrees by the driving pulse Pa and therefore, the locking pulse PL output thereafter is output in the phase for the rotor 10 not to rotate. Therefore, no case is present where the rotor 10 is rotated by the locking pulse PL and thereby, the displayed time becomes wrong.

Patent Document 1: Japanese Patent Application Laid-Open Publication No. 2005-172677

Patent Document 2: Japanese Patent Application Laid-Open Publication No. 2000-75063

Patent Document 3: International Publication No. 95/27926

DISCLOSURE OF INVENTION

Problem to be Solved by the Invention

According to the conventional technique, a vibration of the rotor 10 is detected and thereby, the vibration is determined to be an impact as described above. However, when the vibration of the rotor 10 is simply detected, a vibration that is generated after the rotor 10 is rotated by the driving pulse Pa is also determined to be an impact. Therefore, a given time period after applying the driving pulse Pa is provided as the dead time period T1. However, if an external magnetic field is applied to the timepiece, when the driving pulse Pa is applied, a vibration that is significantly different from the usual vibration may be generated. This is because the position for the rotor 10 to dwell relative to the stator is shifted due to the external magnetic field. In an extreme case, the rotor 10 is not able to stop at a position that corresponds to the next phase and thereby, a rotation of about 360 degrees occurs (that is equivalent to gaining two seconds in one second for a second hand).

The above phenomenon will be described with reference to the accompanying drawings. FIGS. 23 to 27 are plan views of a stepper motor for explaining motions of the rotor 10. FIG. 23 depicts an example where no external magnetic field is present. FIG. 24 depicts an example where a coil is energized with no external magnetic field. FIG. 25 depicts an example where an external magnetic field is applied. FIG. 26 depicts an example where the coil is energized with the external field applied thereto. FIG. 27 depicts an example where the rotor 10 is rotated by 180 degrees with the external magnetic field applied thereto. In FIGS. 23 to 27, "1" denotes the stepper motor; "10" denotes the rotor; "11" denotes a magnet that constitutes the rotor 10; "12" denotes a stator; "13" denotes the coil; and "14" denotes a coil core. The rotor 10 and the magnet 11 are rotatably supported inside a hole a1 provided for the stator 12. Magnetic poles N and S of the magnet 11 dwell at a position of a dwelling angle c2, which is inclined by a specific angle θi relative to an angle c1 in a substantially longitudinal direction of the stator 12. The dwelling angle "c2" of the magnetic poles S and N of the magnet 11 becomes the angle θi because of an inner circumferential shape not depicted that is provided around the hole a1 of the stator 12. When the coil 13 is energized in the state of FIG. 23, the state depicted in FIG. 24 occurs. A magnetic field e1 is generated in the coil core 14 by causing a current to flow in the coil 13, and is transmitted clockwise to the stepper motor 1. Magnetic fields N1 and S1 are generated by the coil 13 at the angle c1 in the substantially longitudinal direction of the stator. Thereby, the magnet 11 repels the magnetic fields N1 and S1 generated by the coil 13, and executes a rotational motion. As described, the dwelling angle c2 of the magnetic poles N and S of the magnet 11 is inclined by the angle θi relative to the angle c1 that is the orientation of the magnetic fields N1 and S1 that are generated by the coil 13. Therefore, the magnet 11 rotates clockwise as indicated by an arrow Y1.

An example where the external magnetic field is applied will be described. FIG. 25 depicts an example where the external magnetic field is applied to the stepper motor 1. In FIG. 25, the external magnetic field e3 is applied from the right to the left of FIG. 25. The external magnetic field e3 runs from the right to the left through the stator 12 and the coil core 14 of the stepper motor 1. Magnetic poles N3 and S3 are generated around the hole a1 of the stator 12 by the external magnetic field e3. Therefore, the magnetic poles N and S of the magnet 11 are affected by the magnetic poles N3 and S3 generated by the external magnetic field e3 and thereby, are not able to dwell at the original dwelling angle c2, and dwell at the position of an angle c3 that differs by θx from the angle c1 in the substantially longitudinal direction of the stator 12.

When the coil 13 is energized in this state, as depicted in FIG. 26, the magnetic field e1 is generated in the coil core 14 and is transmitted clockwise to the stepper motor 1. Thereby, the magnetic fields N1 and S1 are generated in the substantially longitudinal direction c1 of the stator. Therefore, the magnet 11 repels a magnetic field formed by combining the magnetic fields N1 and S1 generated by the coil 13 and the magnetic poles N3 and S3 generated by the external magnetic field e3, and rotates. The magnet 11 rotates 180 degrees to the position depicted in FIG. 27. As depicted, the phase of the magnet 11 in FIG. 27 differs from that in FIG. 25 by 180 degrees and the magnetic pole S is on the left in FIG. 27. At this time, the magnetic poles N and S of the magnet 11, and the magnetic poles N3 and S3 generated by the external magnetic field are in the position relation to repel each other and, thereby, the magnet 11 is not able to stably dwell due to the external magnetic field e3. Therefore, the magnet 11 is further rotated by 180 degrees, which totals 360 degrees, returning to the position depicted in FIG. 25, and dwells there. This results in a gain of two seconds with one sweep of the second hand.

When this phenomenon occurs in a timepiece that does not employ an electromagnetic braking scheme, no serious problem arises. This is because the phase of the magnet 11 does not match the phase of the next driving pulse when the next driving pulse is output and therefore, the magnet 11 cannot be driven. Although the timepiece gains two seconds by a first driving pulse, the next driving pulse is unable to drive the magnet 11 and therefore, the timepiece loses one second. Consequently, overall, the timepiece does not display an incorrect time. When the external magnetic field is removed, the operation of the hands returns to the normal state.

However, if a timepiece employs the electromagnetic braking scheme, problems such as those described below arise. The rotor 10 depicted in FIG. 27 changes in position by rotating to the position depicted in FIG. 25. In most cases, this phenomenon occurs after the dead time period T1 during which the impact detection is not executed, and the time at which the phenomenon occurs is very irregular. This phenomenon occurs during the impact detection time period T2 during which an impact is detected. Therefore, the rotation of the rotor 10 is errantly detected as an impact and the locking pulse PL is output. Usually, the locking pulse is output at a phase for the rotor 10 not to rotate. However, the locking pulse is output on the side on which the rotor 10 is rotated because the rotor 10 rotated by 360 degrees. The rotor 10 is rotated by the locking pulse PL. Similar to the case of the above rotation caused by the driving pulse Pa, the magnet 11 is also rotated 360 degrees by the locking pulse PL. Free vibration generated when the magnet 11 is again rotated 360 degrees is errantly detected as an impact and the locking pulse PL is again output. These phenomena successively occur and thereby, the magnet 11 is rotated again and again. Therefore, an abnormal phenomenon occurs in that the second hand gains several tens of seconds in one real second (hereinafter, "abnormal hand operation in a magnetic field"). This causes the displayed time to significantly differ from the current time, this is a fatal fault of the device as an electronic timepiece. The current consumption of the locking pulse PL is very high and therefore, the successive output of the locking pulse PL causes a significant reduction in the life of the battery.

The errant hand operation in a magnetic field will be described in detail with reference to FIG. 28. As depicted in FIG. 28, the driving pulse Pa is output at the timing s1 that is at the beginning of a second. A time period is provided as the dead time period T1 and thereafter, the operation moves to that in the impact detecting period T2 during which the counter-electromotive voltage generated by the impact is detected using the impact detection signal g. Meanwhile, the rotor 10 is in the magnetic field and executes a 360-degree rotation Q1 during the impact detection time period T2. A counter-electromotive current of the 360-degree rotation Q1 is errantly determined to be the impact detection signal g that indicates generation of the counter-electromotive voltage due to the impact, and the impact detecting circuit 104 outputs the locking pulse PL. Originally, the locking pulse PL is output such that the locking pulse PL brakes and controls the rotor 10. However, the rotor 10 has executed the 360-degree rotation Q1 in the magnetic field and therefore, the phase is inverted and the locking pulse PL is output on the side to rotate the rotor 10. The rotor 10 that is driven by the locking pulse PL and being in the magnetic field, similarly to the driving pulse Pa, also executes a 360-degree rotation Q2.

On the other hand, the dead time period T1 is also provided after the locking pulse PL is output and thereafter, the operation moves to that in the impact detection time period T2. Although the rotor 10 driven by the locking pulse PL executes the 360-degree rotation Q2 as described, the 360-degree rotation Q2 occurs within the impact detection time period T2. The counter-electromotive current generated by the 360-degree rotation Q2 is errantly determined to be the impact detection signal g that is generated by a counter-electromotive voltage generated by an impact and therefore, the impact detecting circuit 104 further outputs the locking pulse PL. The rotor 10 is caused to again rotate by the locking pulse PL. The above operation is repeated and thereby, the rotor 10 is rotated by 360 degrees again and again, resulting in the abnormal hand operation. At a next timing s2, the driving pulse Pa is output from "O2" and no abnormal hand operation occurs because even in a magnetic field because the phase is different. However, at a subsequent timing s3 not depicted, the phase becomes a phase with which the abnormal hand operation occurs.

The abnormal hand operation in a magnetic field tends to occur with a pulse having high driving power and tends not to occur with a pulse having low driving power. For example, in a load compensation system that executes dwelling detection using an ordinary driving pulse and when the magnet dwells, drives the magnet using a correction driving pulse, the ordinary driving pulse has low driving power and causes no abnormal hand operation in a magnetic field. However, when the magnet is driven by the correction driving pulse, the driving power of the correction driving pulse is high such that the correction driving pulse is able to securely drive the magnet even when the load is high. Therefore, the correction driving pulse causes the abnormal hand operation in a magnetic field. Recent electronic timepieces often employ the load compensation system because of its low power consumption and therefore, tend to cause the abnormal hand operation in a magnetic field to occur.

The object of the present invention is to provide an electronic timepiece that solves the problems described and that causes no abnormal hand operation in a magnetic field.

Means for Solving Problem

To the solve the problems above, an electronic timepiece according to the present invention includes a stepper motor that has a coil and a rotor; an ordinary-driving-pulse generating unit that drives the stepper motor; an impact detecting unit that detects a vibration of the rotor, the vibration generated by external impact; and a locking pulse output unit that outputs a locking pulse, the locking pulse braking and controlling the stepper motor if the impact detecting unit detects the impact, where the electronic timepiece further comprises an impact detection control unit that controls prohibition and permission of a detecting operation of the impact detecting unit, based on detection of a predetermined condition.

The electronic timepiece according to the invention further includes a rotation detecting unit that detects rotation and non-rotation of the rotor; and a correction-driving-pulse generating unit that generates a correction driving pulse if the rotation detecting unit determines the non-rotation, based on a detection result, where the impact detection control unit prohibits the detecting operation of the impact detecting unit when the non-rotation is detected, and permits the detecting operation of the impact detecting unit when the rotation is detected.

The electronic timepiece according to the invention is further characterized in that the impact detection control unit, if the correction driving pulse is output successively, continues the impact detection when the correction driving pulse is output for a first time, and prohibits the impact detection when the correction the driving pulse is output for a second time and each successive time thereafter.

The electronic timepiece according to the invention is further characterized in that the ordinary-driving-pulse generating unit includes an ordinary-driving-pulse selecting unit that generates plural ordinary driving pulses having different magnitudes of driving power, that selects one ordinary driving pulse from the plurality of ordinary driving pulses, and that outputs the selected ordinary driving pulse. Further, the impact detection control unit continues the impact detection when the correction driving pulse is output for a first time after the ordinary-driving-pulse selecting unit switches from the selected ordinary driving pulse to an ordinary driving pulse that is smaller than the selected ordinary driving pulse, and prohibits the impact detection when the correction driving pulse is output for a second time and each successive time thereafter.

The electronic timepiece according to the invention further includes an external operation member; and an external input unit that generates an input signal by an operation of the external operation member, where the impact detection control unit executes control of prohibition and permission of impact detection, based on the input signal.

The electronic timepiece according to the invention further includes a magnetic field detecting unit to detect an external magnetic field, where the impact detection control unit executes control of prohibition and permission of impact detection, based on a detection result obtained by the magnetic field detecting unit.

The electronic timepiece according to the invention is further characterized in that the rotation detecting unit or the impact detecting unit is also used as the magnetic field detecting unit.

The electronic timepiece according to the invention is further characterized in that when the impact detection is prohibited, terminals of the coil are shunted.

The electronic timepiece according to the invention is further characterized in that the impact detection control unit permits the impact detecting unit to execute the detecting operation when a predetermined time period has elapsed after the detecting operation of the impact detecting unit is prohibited when the non-rotation is detected.

The electronic timepiece according to the invention further includes a driving pulse control unit that controls permission and stopping of the output of the ordinary driving pulse using the ordinary-driving-pulse generating unit, based on detection of a second predetermined condition, where the detecting operation of the impact detecting unit is permitted after the predetermined time period has elapsed since the stopping of the output of the ordinary driving pulse, by the driving pulse control unit.

The electronic timepiece according to the invention further includes a second stepper motor that has a coil and a rotor; a second ordinary-driving-pulse generating unit that drives the second stepper motor; a second rotation detecting unit that detects rotation and non-rotation of the rotor of the second stepper motor; and a second correction-driving-pulse generating unit that generates the correction driving pulse if the second rotation detecting unit determines the non-rotation, based on a detection result, where the impact detection control unit permits the detecting operation of the impact detecting unit when the rotation is detected by the second rotation detecting unit.

The electronic timepiece according to the invention is characterized in that the impact detection control unit prohibits the detecting operation of the impact detecting unit when the non-rotation is detected by the second rotation detecting unit.

The electronic timepiece according to the invention is further characterized in that a longitudinal direction of the coil of the stepper motor and that of the second stepper motor are disposed parallel to each other.

Effect of the Invention

As described, according to the present invention, when a correction driving pulse is generated in a timepiece employing the electromagnetic braking scheme, abnormal hand operation in a magnetic field may be prevented by limiting output of a locking pulse.

By further providing a second limiting unit, errant operation of a stepper motor due to an impact may be prevented even in an electronic timepiece that employs the multi-stage load correction to reduce current consumption.

In a configuration that causes the hand operation for a hand such as a chrono-hand to arbitrarily start and stop, prohibition and allowance of the output of the locking pulse PL may also be properly controlled.

BRIEF DESCRIPTION OF DRAWINGS

FIG. 15-1 is a block diagram of a circuit configuration of the electronic timepiece having a chronograph function according to a fifth embodiment;

FIG. 15-2 is a diagram of an exemplary disposition of a chrono-motor and a current-time motor;

EXPLANATIONS OF LETTERS OR NUMERALS

Figure 1:
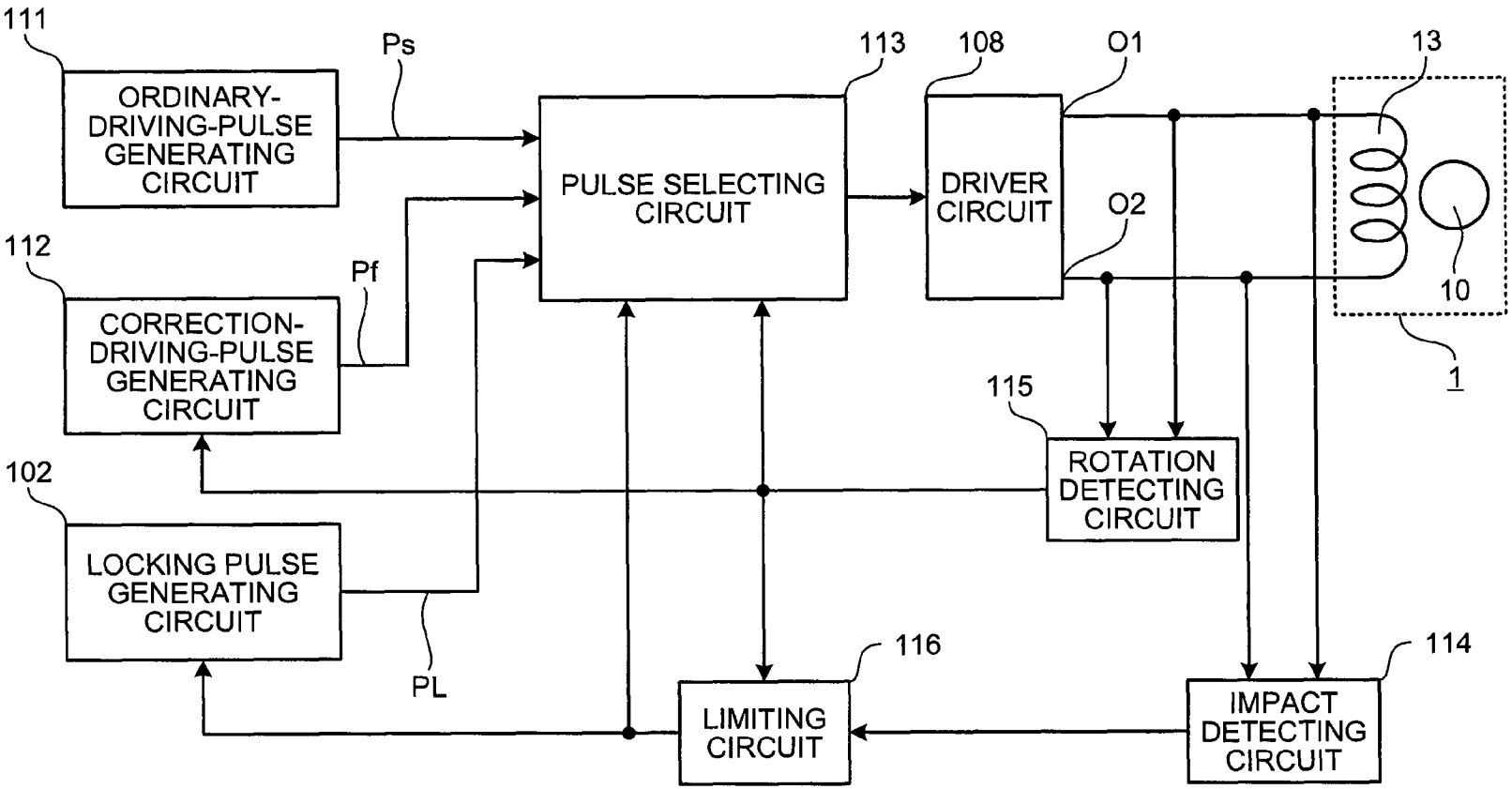
FIG. 1 is a block diagram of a circuit configuration of an electronic timepiece according to a first embodiment of the present invention.

1 stepper motor
10 rotor
11 magnet
12 stator
13 coil
101 driving pulse generating circuit
102 locking pulse generating circuit
111, 121 ordinary-driving-pulse generating circuit
103, 113 pulse selecting circuit
108 driver circuit
104, 114 impact detecting circuit
115 rotation detecting circuit
116 limiting circuit
118 rotation detection storing circuit
120, 130 rank setting circuit
138 ranking-down storing circuit
1101 chrono-motor
1102 chronograph control circuit
1103 time reference signal source
1104 time counting circuit
Pa driving pulse
Ps, Ps1 to Ps5 ordinary driving pulse
Pf correction driving pulse
T2 impact detection time period T2
T3 impact detection prohibition time period T3

BEST MODE(S) FOR CARRYING OUT THE INVENTION

Embodiments will be described with reference to the accompanying drawings.

First Embodiment

Figure 2:
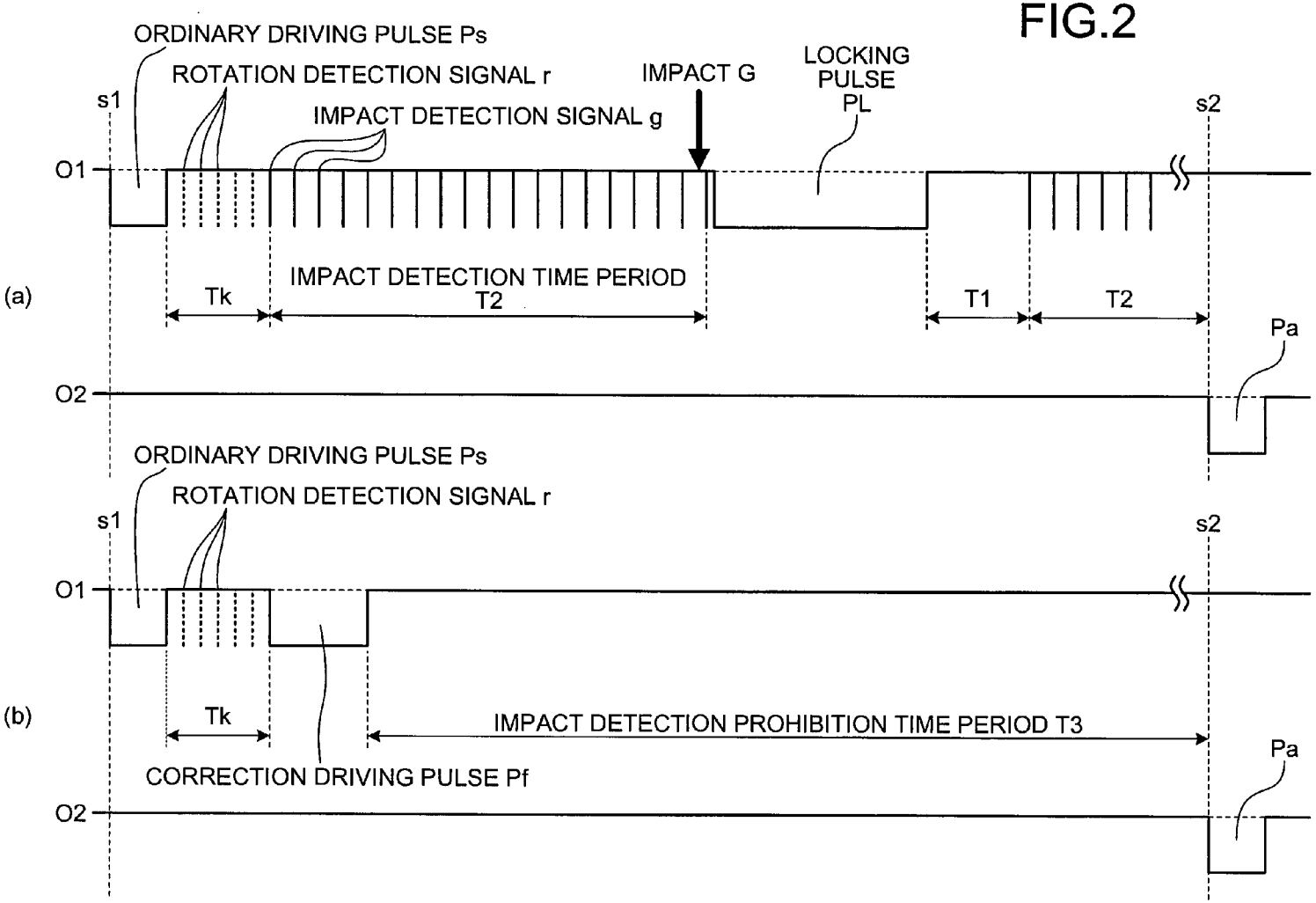
FIG. 2 is a wave diagram for explaining circuit operation of the electronic timepiece according to the present invention (first embodiment)
Figure 3:
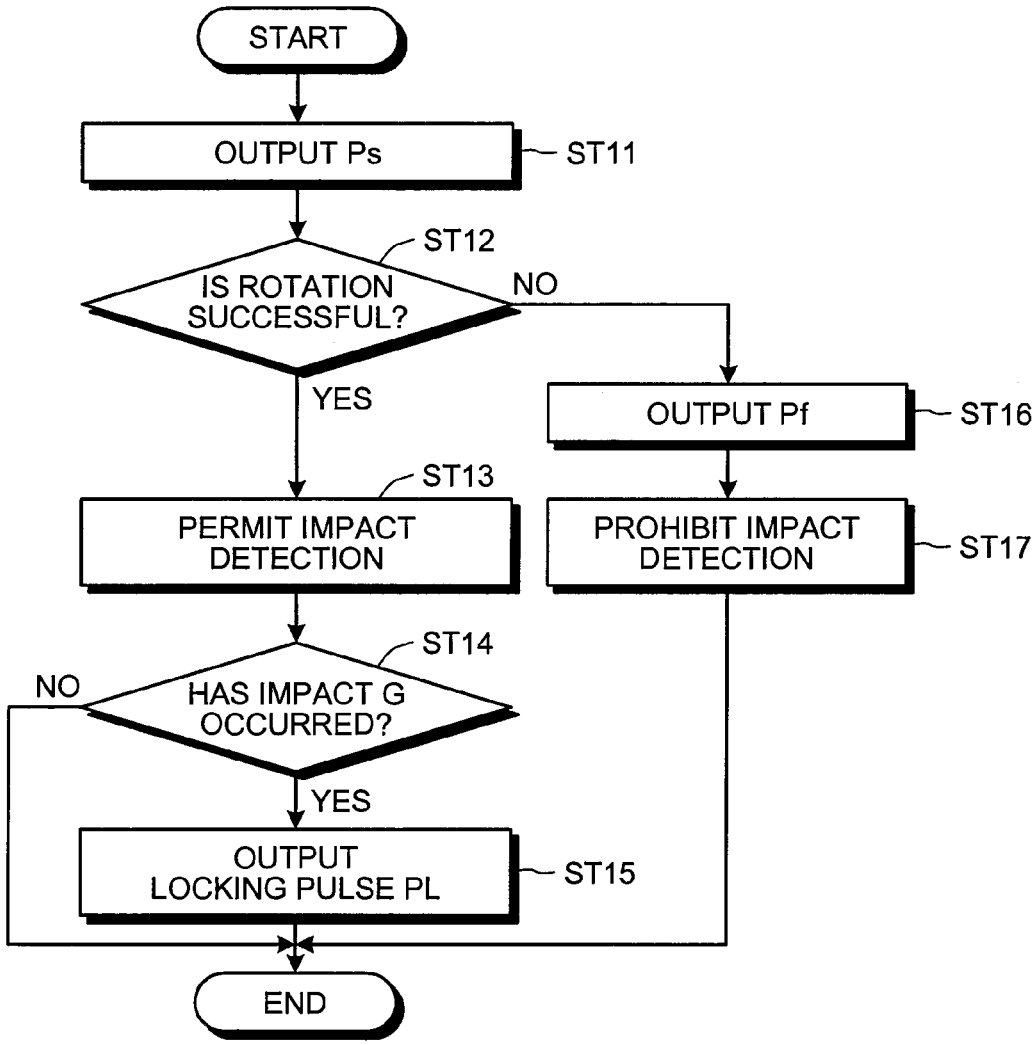
FIG. 3 is a flowchart of operations of the electronic timepiece according to the present invention (first embodiment)

A first embodiment of the present invention will be described in detail with reference to the accompanying drawings. FIG. 1 is a block diagram of a circuit configuration of an electronic timepiece according to the first embodiment. FIG. 2 is a diagram of waveforms output by the electronic timepiece according to the first embodiment. FIG. 3 is a flowchart of operations of circuits of the electronic timepiece according to the first embodiment. Components similar to those described in the example of the conventional art are given the same reference numerals used in the description of the example of the conventional art and will not again be described.

In FIG. 1, "1" denotes the stepper motor that is configured by the rotor 10 and the coil 13; "111" denotes an ordinary-driving-pulse generating circuit that generates an ordinary driving pulse Ps; "112" denotes a correction-driving-pulse generating circuit that generates a correction driving pulse Pf that is output when the ordinary driving pulse Ps is unable to effect driving; "102" denotes the locking pulse generating circuit that generates the locking pulse PL; "113" denotes a pulse selecting circuit that selects the ordinary driving pulse Ps generated by the ordinary-driving-pulse generating circuit 111, the correction driving pulse Pf generated by the correction-driving-pulse generating circuit 112, or the locking pulse PL generated by the locking pulse generating circuit 102; "108" denotes the driver circuit that outputs to the coil 13, a pulse selected by the pulse selecting circuit 113; "115" denotes a rotation detecting circuit that determines success or failure of a rotation using the ordinary driving pulse Ps; "114" denotes an impact detecting circuit that detects presence or absence of an impact using a counter-electromotive current that is generated in the coil 13 by a vibration of the rotor 10; and "116" denotes a limiting circuit that limits the locking pulse P1 based on the result obtained by the rotation detecting circuit 115.

Operations of the circuits will be described with reference to FIGS. 1 and 2. As depicted in (a) of FIG. 2, the ordinary driving pulse Ps is output from the ordinary-driving-pulse generating circuit 111 at the timing s1 that is at the beginning of a second, is selected by the pulse selecting circuit 113, is output to the coil 13 from the terminal O1 of the driving circuit 108, and drives the rotor 10. The rotation detecting circuit 115 executes the detection of success or failure of a rotation of the rotor 10 by detecting the counter-electromotive current generated in the coil 13 during a rotation detection time period Tk, by using a rotation detection signal "r". The rotation detection time period Tk is also used as the dead time period T1 during which no impact detection is executed. When the rotation detecting circuit 115 determines that "the rotation is successful", the rotation detecting circuit 115 controls the pulse selecting circuit 113 such that the pulse selecting circuit 113 does not select and output the correction driving pulse Pf. Therefore, as depicted in (a) of FIG. 2, the correction driving pulse Pf is not output. The limiting circuit 116 receives a signal indicating that "the rotation is successful" from the rotation detecting circuit 115 and permits a detecting operation of the impact detecting circuit 114, and the operation moves to that in the impact detection time period T2 during which an impact is detected. In the impact detection time period T2, the impact detecting circuit 114 periodically detects presence or absence of a counter-electromotive voltage due to the impact using the impact detection signal g. When the counter-electromotive voltage due to an impact G is generated, the locking pulse generating circuit 102 immediately outputs the locking pulse PL. The locking pulse PL is output from the terminal O1 of the driver circuit 108 through the pulse selecting circuit 113, brakes the rotor 10, and prevents the rotor 10 from being rotated due to the impact. When the outputting of the locking pulse PL comes to an end, a given time period during which the vibration of the rotor 10 due to the braking is presumed to end is provided as the dead time period T1. Thereafter, the operation again moves to that in the impact detection time period T2. The impact detection time period T2 continues to the timing s2 that is at the beginning of the subsequent second.

An example where the rotor 10 is unable to be rotated will be described. As depicted in (b) of FIG. 2, the driving pulse Ps is output from the ordinary-driving-pulse generating circuit 111 at the timing s1 that is at the beginning of a second, is selected by the pulse selecting circuit 113, and is output to the coil 13 from the terminal O1 of the driving circuit 108. The operations executed until the rotation detecting circuit 115 executes an operation to detect whether the rotor 10 has rotated, by using the rotation detection signal r to detect the counter-electromotive current generated in the coil 13, are same as those executed in when the rotation is successful. When the rotation detecting circuit 115 determines that "the rotation has failed", the rotation detecting circuit 115 controls the pulse selecting circuit 113 such that the pulse selecting circuit 113 selects and outputs the correction driving pulse Pf. Therefore, the correction driving pulse Pf is output from the terminal O1 of the driver circuit 108 through the pulse selecting circuit 113 and the correction driving pulse Pf again drives the rotor 10. Meanwhile, the limiting circuit 116 receives a signal indicating that "the rotation has failed" from the rotation detecting circuit 115 and limits the detecting of the impact detecting circuit 114, and an impact detection prohibition time period T3 begins, during which impact detection is not executed. The impact detection prohibition time period T3 continues until the timing s2 that is at the beginning of the subsequent second.

The operations will be described with reference to the flowchart of FIG. 3. The ordinary driving pulse Ps is output at the timing that is at the beginning of a second (step ST11). The rotation detecting circuit 115 executes the rotation detection (step ST12). If it is determined that "the rotation is successful" (step ST12: YES), the impact detection is permitted (step ST13). The impact detecting circuit 114 executes impact detection (step ST14). If impact G is detected (step ST14: YES), the locking pulse PL is output (step ST15). On the other hand, if it is determined at step ST12 that "the rotation has failed" (step ST12: NO), the correction driving pulse Pf is output (step ST16) and the impact detection is prohibited (step ST17).

As described, when the correction driving pulse Pf is generated, the impact detection is prohibited, canceling generation of the locking pulse PL. Consequently, errant operation of the hands in a magnetic field due to an external magnetic field is prevented.

The impact detecting circuit 114 does not execute impact detection during the impact detection prohibition time period T3 and, if impact occurs, no locking pulse PL is output and the rotor 10 may errantly rotate due to the impact. Therefore, during the impact detection prohibition time period T3, it is desirable for the terminals O1 and O2 of the coil 13 to be shunted (short-circuited) during the impact detection prohibition time period T3. More specifically, the terminals O1 and O2 of the driver circuit 108 output the same fixed potential. Thereby, the electromagnetic braking is caused to operate and resistance to impacts is improved.

If "the rotation has failed" due to the ordinary driving pulse Ps as described, the impact detection prohibition time period T3 begins, making the timepiece vulnerable to impact. To cope with this, by causing the ordinary driving pulse Ps to have relatively high driving power, situations where "the rotation has failed" are prevented as far as possible, thereby, preventing vulnerability to impact.

Second Embodiment

A second embodiment of the present invention will be described in detail with reference to the accompanying drawings. The second embodiment is an example where ordinary driving pulses having different ranks of driving power are prepared as the ordinary driving pulses. In each of electronic timepieces disclosed in Patent Documents 2 and 3, to suppress current consumption as far as possible, a method is employed of selecting and outputting an ordinary driving pulse having the lowest power to be able to effect driving, from among ordinary driving pulses. The following two operations are executed as the selecting method of the ordinary driving pulse in the above case. First, when an ordinary driving pulse of a given power rank is unable to effect driving, a correction driving pulse is output to again effect driving and the ordinary driving pulse is switched at the next driving session to another ordinary driving pulse whose power rank is one rank higher. Second, when an ordinary driving pulse having a given power rank is able to continuously effect driving (for example, when the ordinary driving pulse is able to continuously drive for four minutes), the ordinary driving pulse is switched at the next driving session to another ordinary driving pulse whose power rank is one rank lower. The ordinary driving pulse is selected using the two operations, thereby reducing current consumption.

Figure 4:
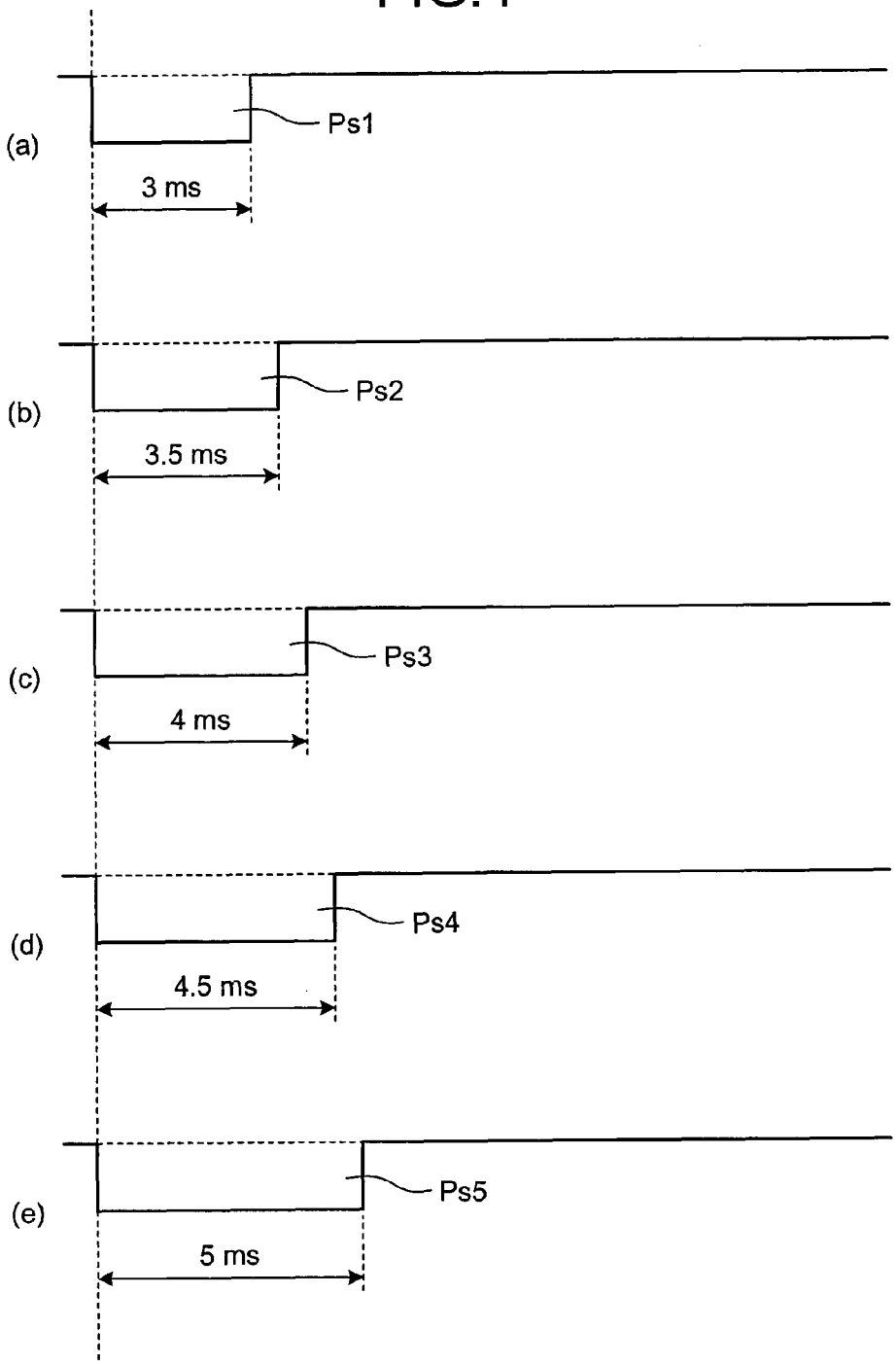
FIG. 4 is a wave diagram of pulses generated by the electronic timepiece according to the present invention (second embodiment)

The operations will be described. FIG. 4 is a diagram of waveforms that represent ordinary driving pulses Ps1 to Ps5 in the second embodiment. The ordinary driving pulses Ps1 to Ps5 are pulses respectively having lengths of 3.0 ms, 3.5 ms, 4.0 ms, 4.5 ms, and 5.0 ms. An example will be described where the ordinary driving pulse Ps3 is the smallest pulse that is able to effect driving and the ordinary driving pulse Ps2 is unable to effect driving. In a case where the ordinary driving pulse Ps3 continuously drives, when four minutes elapse, the ordinary driving pulse Ps3 is switched to the ordinary driving pulse Ps2 whose power rank is one rank lower than that of the ordinary driving pulse Ps3. However, the ordinary driving pulse Ps2 is unable to effect driving; the correction driving pulse Pf again effects driving; and the next driving pulse effects driving and is the ordinary driving pulse Ps3 whose power rank is one rank higher than the ordinary driving pulse Ps2. On the contrary, when the ordinary driving pulse Ps4 drives whose driving power is high, after four minutes, the ordinary driving pulse Ps4 is switched to the ordinary driving pulse Ps3 whose power rank is one rank lower than that of the ordinary driving pulse Ps4; thereby, the ordinary driving pulse Ps3 whose power rank is lowest can be selected (hereinafter, "multi-stage load correction" for the load correction system employing this scheme).

However, when a multi-stage-load-correction electronic timepiece employs the scheme of the first embodiment, the following problem arises. In the electronic timepiece that employs the multi-stage load correction, the ordinary driving pulse Ps2 whose power is low and is unable to drive is applied once during the four minutes as described. In this case, the correction driving pulse Pf effects driving. According to the scheme of the first embodiment, no impact detection is executed for one second during every four minutes and therefore, a state occurs where the timepiece is vulnerable to impact. The second embodiment is an example that copes with the above deficiency, where output of the locking pulse is limited when each of consecutive rotation detection sessions results in a determination of dwelling.

Figure 5:
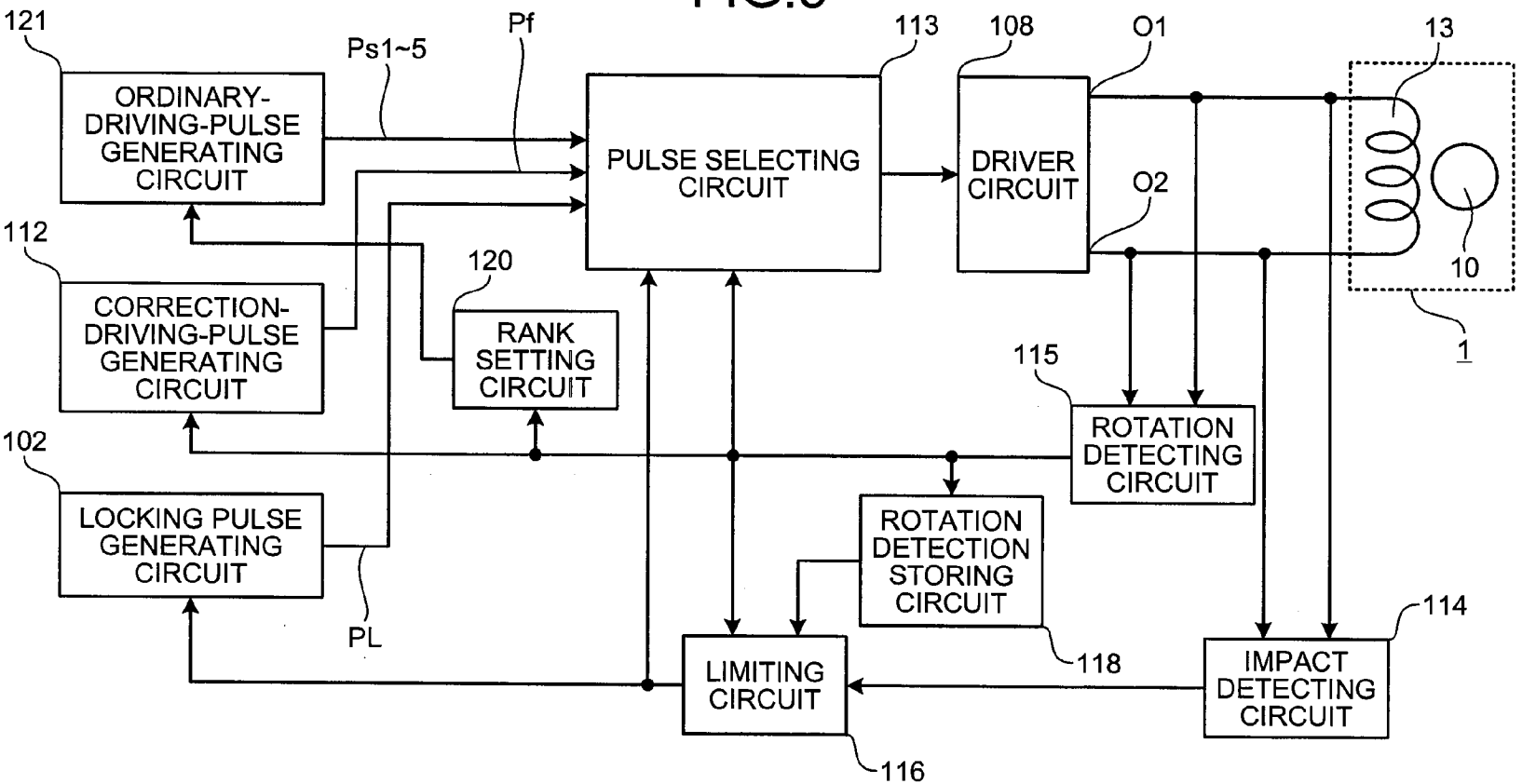
FIG. 5 is a block diagram of a circuit configuration of the electronic timepiece according to the present invention (second embodiment)
Figure 6:
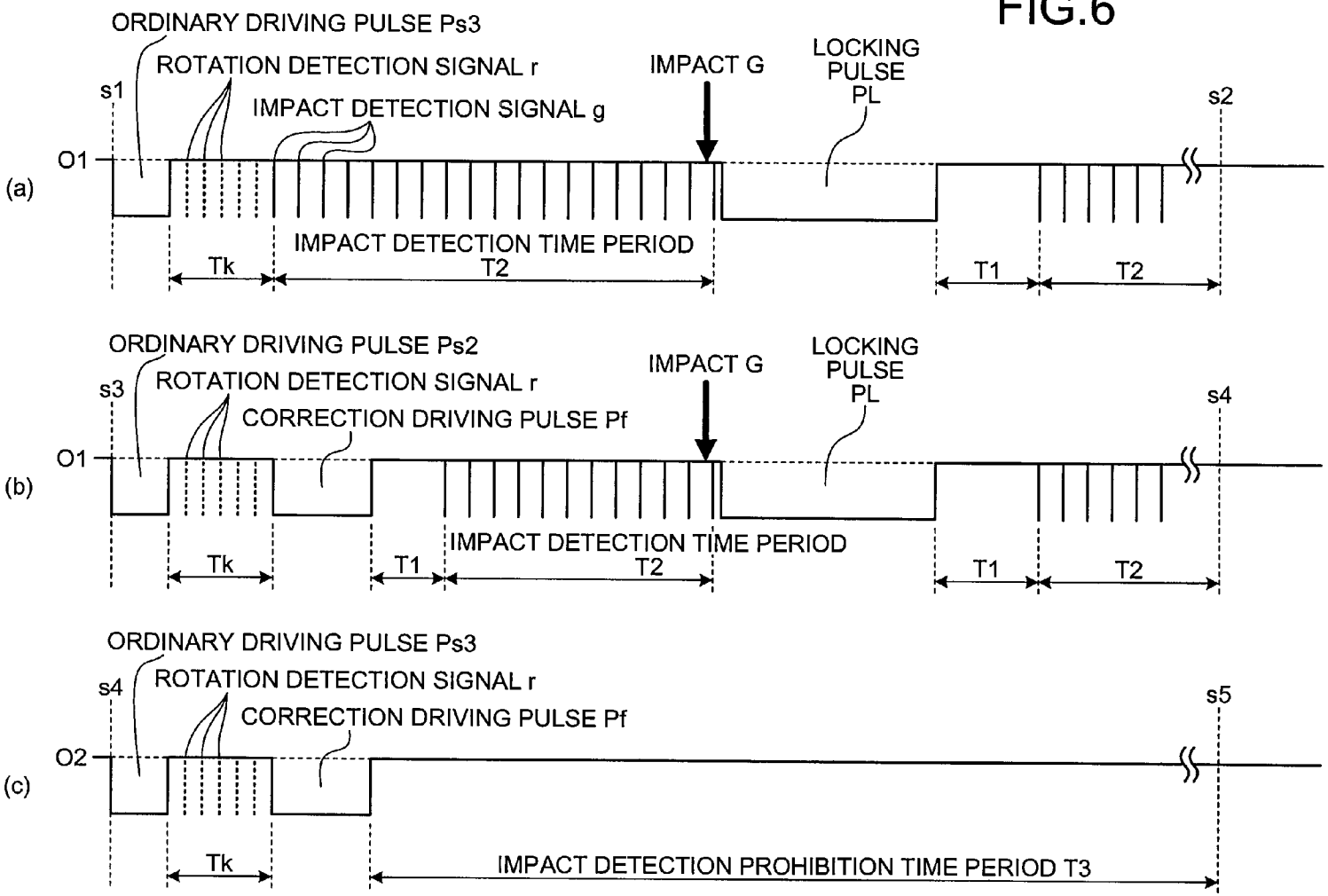
FIG. 6 is a wave diagram for explaining circuit operation of the electronic timepiece according to the present invention (second embodiment)
Figure 7:
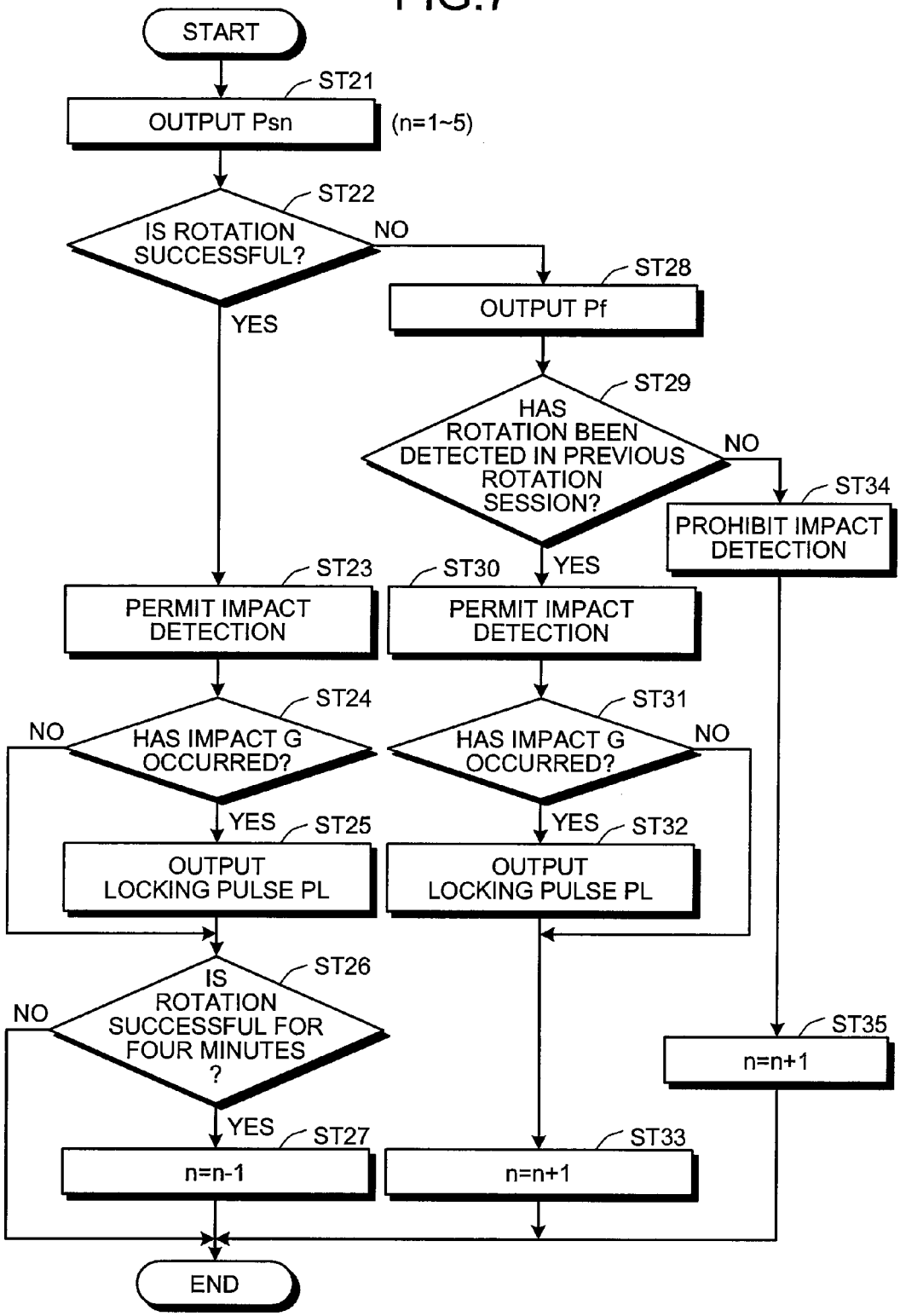
FIG. 7 is a flowchart of operations of the circuits of the electronic timepiece according to the present invention (second embodiment)

FIG. 5 is a block diagram of a circuit configuration of the electronic timepiece according to the second embodiment. FIG. 6 is a diagram of waveforms output by the electronic timepiece of the second embodiment. FIG. 7 is a flowchart of operations of the circuits of the electronic timepiece according to the second embodiment. Components similar to those described in the example of the conventional art and in the first embodiment are given the same reference numerals used in description of the conventional art and of the first embodiment, and will not again be described. In FIG. 5, "1" denotes the stepper motor that is configured by the rotor 10 and the coil 13; "121" denotes an ordinary-driving-pulse generating circuit that generates ordinary driving pulses Psi to Ps5 depicted in FIG. 4; "112" denotes the correction-driving-pulse generating circuit; "102" denotes the locking pulse generating circuit; "113" denotes the pulse selecting circuit; "108" denotes the driver circuit; "115" denotes the rotation detecting circuit; "114" denotes the impact detecting circuit; and "116" denotes the limiting circuit that limits the locking pulse PL according to the detection result of the rotation detecting circuit 115 and the stored content of a rotation detection storing circuit 118. "118" denotes the rotation detection storing circuit that has stored therein the detection result of the rotation detecting circuit 115 and that controls the limiting circuit 116 based on the detection result. The rotation detection storing circuit 118 is a second limiting unit that limits output of the locking pulse. "120" denotes a rank setting circuit that selects the ordinary driving pulses Ps1 to Ps5 based on the detection result of the rotation of the rotation detecting circuit 115.

Operations of the circuits will be described with reference to FIGS. 5 and 6. (a) of FIG. 6 is substantially identical to (a) of FIG. 2. Ps3 is output from the ordinary-driving-pulse generating circuit 111 at the timing s1 that is at the beginning of a second, is selected by the pulse selecting circuit 113, is output to the coil 13 from the terminal O1 of the driving circuit 108, and drives the rotor 10. The rotation detecting circuit 115 executes the detection of success or failure of a rotation of the rotor 10 by detecting the counter-electromotive current generated in the coil 13 during a rotation detection time period Tk by using a rotation detection signal "r". The rotation detection time period Tk is also used as the dead time period T1 during which no impact detection is executed. When the rotation detecting circuit 115 determines that "the rotation is successful", the rotation detecting circuit 115 controls the pulse selecting circuit 113 such that the pulse selecting circuit 113 does not select and output the correction driving pulse Pf. Therefore, as depicted in (a) of FIG. 6, the correction driving pulse Pf is not output. Further, at this time, "rotation has failed" is stored to the rotation detection storing circuit 118. The limiting circuit 116 receives a signal indicating that "the rotation is successful" from the rotation detecting circuit 115 and permits a detecting operation of the impact detecting circuit 114, and the operation moves to that in the impact detection time period T2 during which an impact is detected. In the impact detection time period T2, the impact detecting circuit 114 periodically detects presence or absence of a counter-electromotive voltage due to the impact using the impact detection signal g. When the counter-electromotive voltage due to an impact G is generated, the locking pulse generating circuit 102 immediately outputs the locking pulse PL. The locking pulse PL is output from the terminal O1 of the driver circuit 108 through the pulse selecting circuit 113, brakes the rotor 10, and prevents the rotor 10 from being rotated due to the impact. When the outputting of the locking pulse PL comes to an end, a given time period during which the vibration of the rotor 10 due to the braking is presumed to end is provided as the dead time period T1. Thereafter, the operation again moves to that in the impact detection time period T2. The impact detection time period T2 continues to the timing s2 that is at the beginning of the subsequent second.

If the rotation detecting circuit 115 determines that the rotation has been continued by the ordinary driving pulse Ps3 for four minutes, the rank setting circuit 120 controls the ordinary-driving-pulse generating circuit 121 such that the ordinary-driving-pulse generating circuit 121 switches the ordinary driving pulse Ps3 to the ordinary driving pulse Ps2 whose driving power is one rank lower than that of the ordinary driving pulse Ps3. The operation of switching an ordinary driving pulse to another ordinary driving pulse whose driving power is one rank lower will be referred to as "ranking-down operation".

(b) of FIG. 6 is a diagram of the waveform obtained when the ordinary driving pulse Ps3 is switched to the ordinary driving pulse Ps2 at the timing s3 that is at the beginning of a second. The ordinary driving pulse Ps2 is output from the ordinary-driving-pulse generating circuit 121 at the timing s3 that is at the beginning of a second, is selected by the pulse selecting circuit 113, and is output from the terminal O1 of the driver circuit 108 to the coil 13. The rotation detecting circuit 115 detects success or failure of the rotation of the rotor 10. The ordinary driving pulse Ps2 has low driving power and is unable to rotate the rotor 10, and the rotation detecting circuit 115 determines that "the rotation has failed". The rotation detecting circuit 115 controls the pulse selecting circuit 113 such that the pulse selecting circuit 113 selects and outputs the correction driving pulse Pf. Thereby, the correction driving pulse Pf is output from the terminal O1 of the driver circuit 108 through the pulse selecting circuit 113 and again drives the rotor 10. "Rotation has failed" is stored to the rotation detection storing circuit 118. On the other hand, the limiting circuit 116 receives a signal indicating that "the rotation has failed" from the rotation detecting circuit 15 and a signal indicating that "the rotation is successful in the previous session (at the timing s2 that is at the beginning of a second)" from the rotation detection storing circuit 118 and permits the detecting operation of the impact detecting circuit 114, and the impact detection time period T2 during which impact detection is executed, begins. Prior to the impact detection time period T2, a given time period during which the vibration due to the correction driving pulse Pf is presumed to come to an end is provided as the dead time period T1 during which no impact detection is executed. Therefore, similar to the example of FIG. 6(*a*) where it is determined that the rotor is moving, when the counter-electromotive voltage due to the impact G is generated, the locking pulse generating circuit 102 immediately outputs the locking pulse PL and brakes the rotor 10. The impact detection time period T2 continues to a timing s4 that is at the beginning of the subsequent second.

At the timing s3 that is at the beginning of a second, the rotation detecting circuit 115 determines that "the rotation has failed", based on the ordinary driving pulse Ps2. Consequently, the rank setting circuit 120 controls the ordinary-driving-pulse generating circuit 121 at the timing s4 that is at the beginning of the subsequent second such that the ordinary-driving-pulse generating circuit 121 switches the ordinary driving pulse Ps2 to the ordinary driving pulse Ps3 whose power rank is one rank higher than that of the ordinary driving pulse Ps2. The operation of switching an ordinary driving pulse to another ordinary driving pulse whose driving power is one rank higher will be referred to as "ranking-up operation".

(c) of FIG. 6 is a diagram of a waveform obtained when the ordinary driving pulse Ps2 is switched to the ordinary driving pulse Ps3 at the timing s4 that is at the beginning of a second. (c) of FIG. 6 depicts an example where gear train load is increased at the timing s4 compared to that at the timings s1 to s3 that are at the beginning of seconds and therefore, the ordinary driving pulse Ps3 is unable to effect driving. The ordinary driving pulse Ps3 is output from the ordinary-driving-pulse generating circuit 121 at the timing s4 that is at the beginning of a second, is selected by the pulse selecting circuit 113, and is output from the terminal O1 of the driver circuit 108 to the coil 13. However, the gear train load is increased and the rotor 10 is unable to rotate. Therefore, the rotation detecting circuit 115 determines that "the rotation has failed". The rotation detecting circuit 115 controls the pulse selecting circuit 113 such that the pulse selecting circuit 113 selects and outputs the correction driving pulse Pf. Therefore, the correction driving pulse Pf is output from the terminal O1 of the driver circuit 108 through the pulse selecting circuit 113 and the correction driving pulse Pf again drives the rotor 10. "The rotation has failed" is stored to the rotation detection storing circuit 118. Meanwhile, the limiting circuit 116 receives a signal indicating that "the rotation has failed" from the rotation detecting circuit 115 and a signal indicating that "the rotation has failed in the previous session (at the timing s3 that is at the beginning of a second)" from the rotation detection storing circuit 118 and limits detection executed by the impact detecting circuit 114, and the impact detection prohibition time period T3 during which impact detection is not executed, begins. The impact detection prohibition time period T3 continues until the timing s5 that is at the beginning of the subsequent second.

Operation will be described with reference to the flowchart of FIG. 7. The ordinary driving pulse Psn (where "n" is an integer taking a value from 1 to 5) is output at a timing that is at the beginning of a second (step ST21). The rotation detecting circuit 115 executes rotation detection (step ST22). If it is determined that "the rotation is successful" (step ST22: YES), impact detection is permitted (step ST23). If the occurrence of impact has been detected (step ST24: YES), the locking pulse PL is output (step ST25). It is checked whether the same ordinary driving pulse Psn maintained the state where "the rotation is successful" for four minutes (step ST26). If the rotation is detected for the four minutes with the same ordinary driving pulse Psn (step ST26: YES), the ranking-down operation of reducing the power of the ordinary driving pulse Psn that is output at the next timing that is at the beginning of a second is executed by reducing n by one (step ST27).

On the other hand, if it is determined at step ST22 that "the rotation has failed" (step ST22: NO), the correction driving pulse Pf is output (step ST28). The rotation detection storing circuit 118 determines the result of the rotation detection in the previous session (step ST29). If it is determined that the result of the rotation detection in the previous session is that "the rotation is executed" (step ST29: YES), impact detection is permitted (step ST30). If the occurrence of impact is detected (step ST31: YES), the locking pulse PL is output (step ST32). The ranking-up operation of increasing the power of the ordinary driving pulse Psn that is output at the next timing that is at the beginning of a second is executed by increasing n by one (step ST33).

If the result of the rotation detection in the previous session is determined at step ST29 indicates that "the rotation has failed" (step ST29: NO), the impact detection is prohibited (step ST34). The ranking-up operation of increasing the power of the ordinary driving pulse Psn that is output at the next timing that is at the beginning of a second is executed by increasing n by one (step ST35).

As described, if the results "the rotation has failed" are consecutively obtained, the impact detection is permitted for the first correction driving pulse Pf and the impact is coped with and, when the second and succeeding correction driving pulses Pf are generated, the impact detection is prohibited and the generation of the locking pulse PL is cancelled. For the correction driving pulse Pf that is generated once in four minutes due to the ranking-down operation, the impact detection is permitted and the impact is coped with. For the correction driving pulses Pf generated thereafter, the impact detection is prohibited and thereby, the impact is coped with and the occurrence of errant hand operation in a magnetic field due to an external magnetic field is prevented.

The result that "the rotation has failed" due to the ranking-down operation regularly occurs every four minutes as described and does not occur due to the anomaly of the stepper motor 1. However, when the result that "the rotation has failed" due to the ranking-down operation and generation of an external magnetic field accidentally occur simultaneously, errant hand operation in a magnetic field may occur. However, the probability is very low that the timepiece is put in an external magnetic field with which errant hand operation in a magnetic field immediately occurs during the ranking-down operation that occurs once in four minutes.

In a case where the rotation has failed due to an event other than the ranking-down operation and impact is sustained, no impact detection is executed and therefore, the locking pulse PL is not output and the timepiece becomes vulnerable to impact. However, for a case where the rotation has failed due to an event other than the ranking-down operation may be due to 1: the load suddenly varying, during which the probability is very low that impact is sustained simultaneously; and 2: it is determined that the rotation has failed due to the effect of an external magnetic field and in this case, the probability that impact is sustained when an external magnetic field is applied is very low. Furthermore, preferably, the locking pulse PL is not output to cope with the errant hand operation in a magnetic field.

Third Embodiment

A third embodiment of the present invention will be described in detail with reference to the accompanying drawings. Similar to the second embodiment, the third embodiment is an embodiment that supports multi-stage load correction and according to the embodiment, the output of the locking pulse is limited when it is determined that the rotor dwells in a first session of rotation detection after the ranking-down operation.

Figure 8:
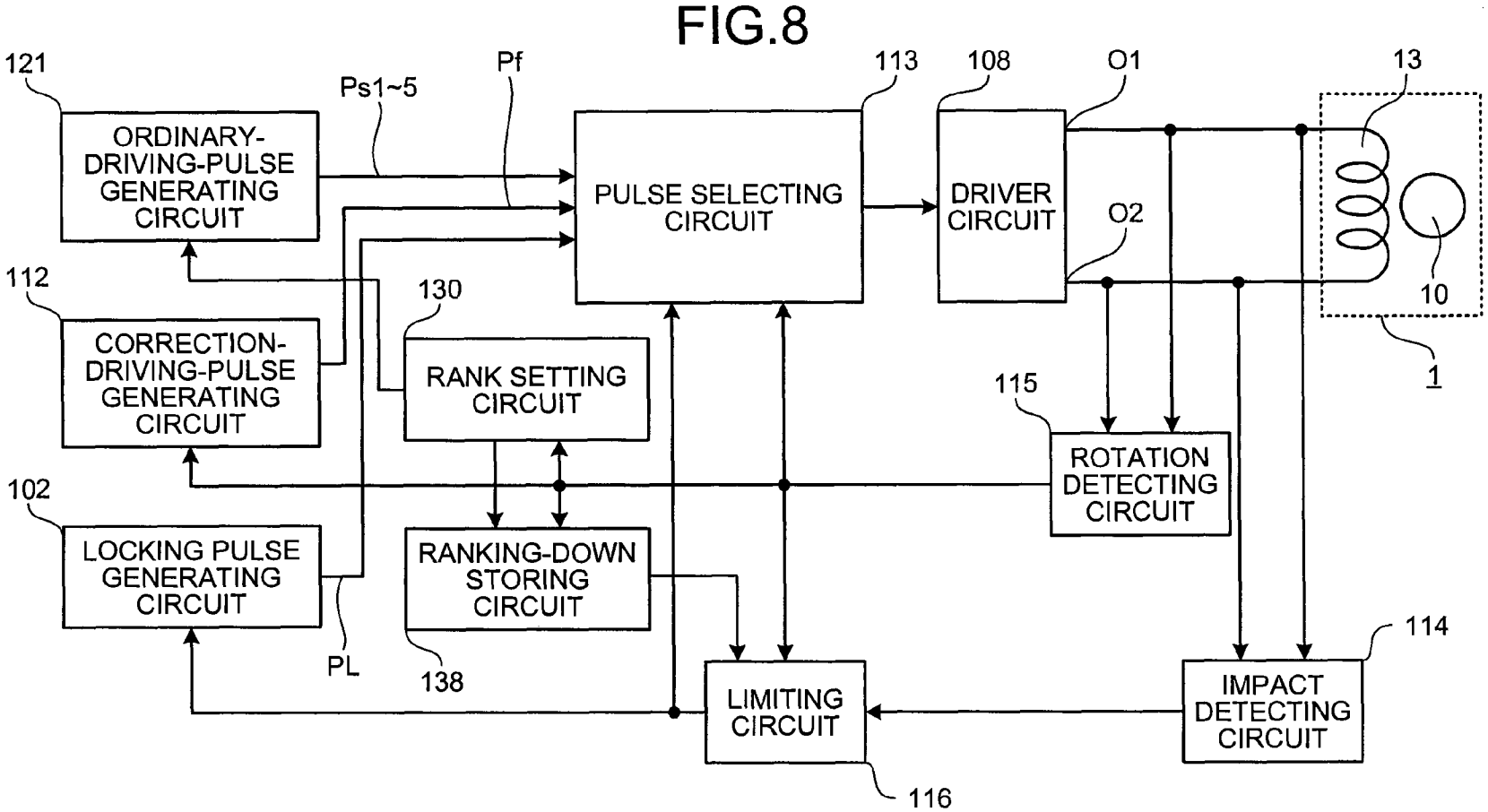
FIG. 8 is a block diagram of a circuit configuration of the electronic timepiece according to the present invention (third embodiment)
Figure 9:
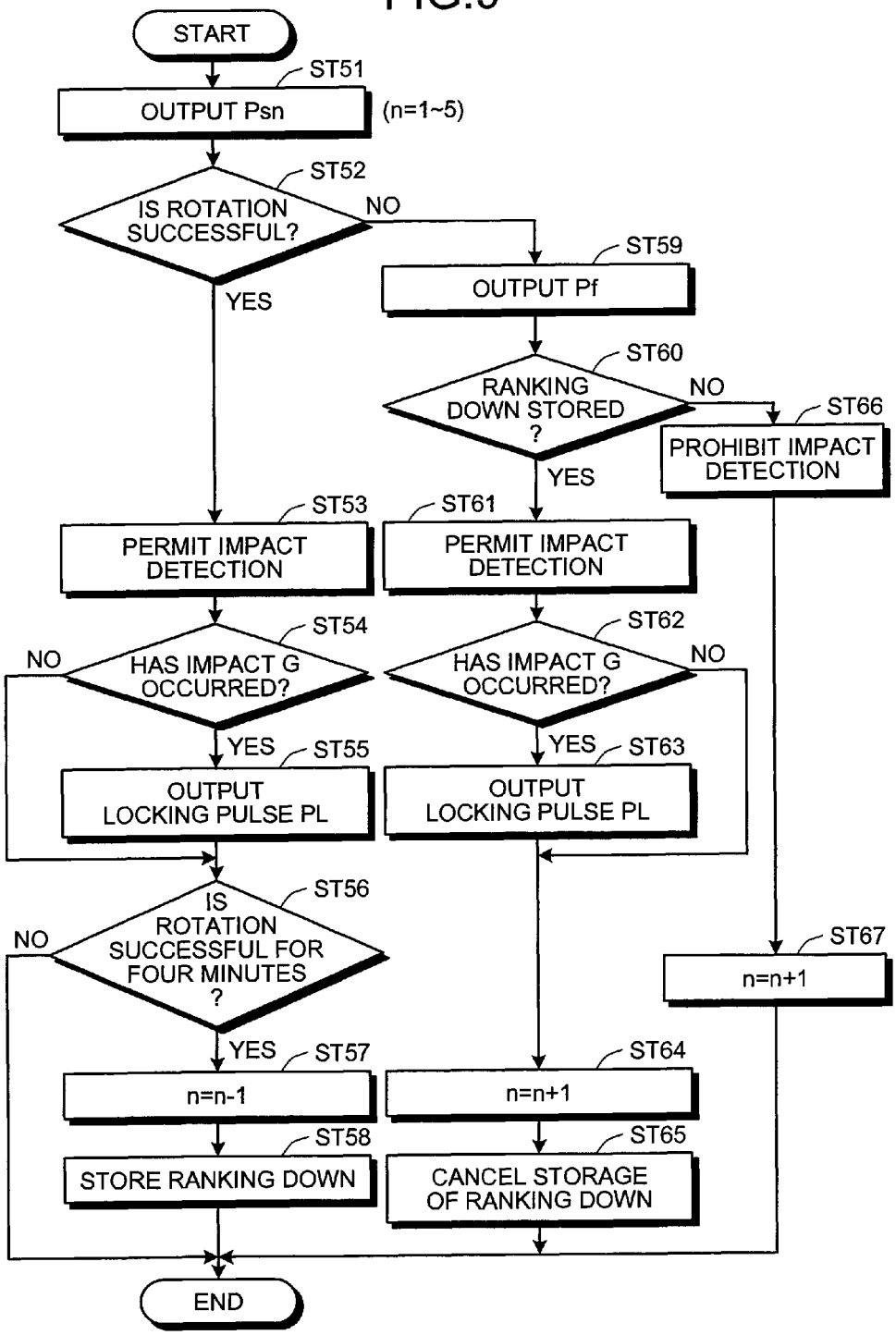
FIG. 9 is a flowchart of operations of circuits of the electronic timepiece according to the present invention (third embodiment)

FIG. 8 is a block diagram of a circuit configuration of the electronic timepiece according to the third embodiment. FIG. 6 is a diagram of waveforms output by the electronic timepiece according to the third embodiment (the same diagram as that of the second embodiment). FIG. 9 is a flowchart of operations of circuits of the electronic timepiece according to the third embodiment. Components similar to those described in the example of the conventional art and the first and the second embodiments are given the same reference numerals used in the respective descriptions thereof and will not again be described. In FIG. 8, "1" denotes the stepper motor that is configured by the rotor 10 and the coil 13; "121" denotes the ordinary-driving-pulse generating circuit that generates the ordinary driving pulses Ps1 to Ps5 depicted in FIG. 4; "112" denotes the correction-driving-pulse generating circuit; "102" denotes the locking-pulse-generating circuit; "113" denotes the pulse selecting circuit; "108" denotes the driver circuit; "115" denotes the rotation detecting circuit; "114" denotes the impact detecting circuit; "116" denotes the limiting circuit that limits the locking pulse PL based on the detection result obtained by the rotation detecting circuit 115 and the stored content of a ranking-down storing circuit 138 described later; "130" denotes a rank setting circuit that selects the ordinary driving pulses Psi to Ps5 based on the result obtained by the rotation detection of the rotation detecting circuit 115; and "138" denotes a ranking-down storing circuit that controls the control circuit 116, based on the detection result obtained by the rotation detecting circuit 115 and a signal of the rank setting circuit 130. The ranking-down storing circuit 138 is a second limiting unit that limits the outputting of the locking pulse.

Circuit operations will be described with reference to FIGS. 8 and 6. In the third embodiment, the waveform is the same as that depicted in FIG. 6(*a*) of the second embodiment. The ordinary driving pulse Psi is output from the ordinary-driving-pulse generating circuit 121 at the timing s1 that is at the beginning of a second, is selected by the pulse selecting circuit 113, is output from the terminal O1 of the driver circuit 108 to the coil 13, and drives the rotor 10. The rotation detecting circuit 115 detects success or failure of the rotation of the rotor 10 by detecting the rotation detection signal r that is generated in the coil 13 during the rotation detection time period Tk. The rotation detection time period Tk is also used as the dead time period T1 during which no impact detection is executed. If the rotation detecting circuit 115 determines that "the rotation is successful", the rotation detecting circuit 115 controls the pulse selecting circuit 113 such that the pulse selecting circuit 113 does not select and output the correction driving pulse Pf. Therefore, as depicted in FIG. 6(*a*), the correction driving pulse Pf is not output. The limiting circuit 116 receives a signal indicating that "the rotation is successful" from the rotation detecting circuit 115 and permits a detecting operation of the impact detecting circuit 114, and the impact detection time period T2 during which an impact is detected, begins. In the impact detection time period T2, the impact detecting circuit 114 periodically detects the presence or absence of a counter-electromotive voltage due to the impact, using the impact detection signal g. When the counter-electromotive voltage due to the impact G is generated, the locking pulse generating circuit 102 immediately outputs the locking pulse PL and the locking pulse PL is output from the terminal O1 of the driver circuit 108 through the pulse selecting circuit 113. The locking pulse PL brakes the rotor 10 and prevents the rotor 10 from being rotated due to the impact. When the outputting of the locking pulse PL comes to an end, a given time period during which the vibration of the rotor 10 due to the braking is presumed to come to an end is provided as the dead time period T1 during which no impact detection is executed. Thereafter, the impact detection time period T2 begins. The impact detection time period T2 continues until the timing s2 that is at the beginning of the subsequent second.

If the rotation detecting circuit 115 determines that the rotation has been continued by the ordinary driving pulse Ps3 for four minutes, the rank setting circuit 130 controls the ordinary-driving-pulse generating circuit 121 such that the ordinary-driving-pulse generating circuit 121 executes the ranking-down operation to switch the ordinary driving pulse Ps3 to the ordinary driving pulse Ps2 whose driving power is one rank lower than that of the ordinary driving pulse Ps3. Indication that the ranking-down operation has been executed is stored to the ranking-down storing circuit 138.

FIG. 6(*b*) depicts the waveform obtained when the ordinary driving pulse Ps3 is switched to the ordinary driving pulse Ps2 at the timing s3 that is at the beginning of a second. The ordinary driving pulse Ps2 is output from the ordinary-driving-pulse generating circuit 121 at the timing s3 that is at the beginning of a second, is selected by the pulse selecting circuit 113, and is output from the terminal O1 of the driver circuit 108 to the coil 13. The rotation detecting circuit 115 detects success or failure of the rotation of the rotor 10. The ordinary driving pulse Ps2 has low driving power and is unable to rotate the rotor 10, and the rotation detecting circuit 115 determines that "the rotation has failed". The rotation detecting circuit 115 controls the pulse selecting circuit 113 such that the pulse selecting circuit 113 selects and outputs the correction driving pulse Pf. Thereby, the correction driving pulse Pf is output from the terminal O1 of the driver circuit 108 through the pulse selecting circuit 113 and again drives the rotor 10. The limiting circuit 116 receives a signal indicating that "the rotation has failed" from the rotation detecting circuit 115 and a signal indicating that "the ranking-down operation is executed" from the ranking-down storing circuit 138 and therefore, permits a detecting operation of the impact detecting circuit 114, and the impact detection time period T2 during which impact detection is executed begins. Prior to the impact detection time period T2, a given time period during which the vibration due to the correction driving pulse Pf is presumed to come to an end is provided as the dead time period T1 during which no impact detection is executed. Therefore, similar to the example depicted in FIG. 6(*a*) where it is determined that the rotor is moving, when the counter-electromotive voltage due to the impact G is generated, the locking pulse generating circuit 102 immediately outputs the locking pulse PL and brakes the rotor 10. The impact detection time period T2 continues until the timing s4 that is at the beginning of the subsequent second.

At the timing s3 that is at the beginning of a second, the rotation detecting circuit 115, using the ordinary driving pulse Ps2, determines that "the rotation has failed" and therefore, the rank setting circuit 130 controls the ordinary-driving-pulse generating circuit 121 at the timing s4 that is at the beginning of the subsequent second such that the ordinary-driving-pulse generating circuit 121 executes the ranking-up operation to switch the ordinary driving pulse Ps2 to the ordinary driving pulse Ps3 whose rank of driving power is one rank higher than that of the ordinary driving pulse Ps2. The rotation detecting circuit 115 determines that "the rotation has failed" and therefore, the ranking-down storing circuit 138 cancels the storage operation to indicate that the ranking-down operation has been executed.

FIG. 6(*c*) is a diagram of a waveform obtained when the ordinary driving pulse Ps2 is switched to the ordinary driving pulse Ps3 at the timing s4 that is at the beginning of a second. The ordinary driving pulse Ps3 is output from the ordinary-driving-pulse generating circuit 121 at the timing s4 that is at the beginning of a second, is selected by the pulse selecting circuit 113, and is output from the terminal O1 of the driver circuit 108 to the coil 13. However, the gear train load has increased and the rotor 10 is unable to rotate. The rotation detecting circuit 115 determines that "the rotation has failed". The rotation detecting circuit 115 controls the pulse selecting circuit 113 such that the pulse selecting circuit 113 selects and outputs the correction driving pulse Pf. Therefore, the correction driving pulse Pf is output from the terminal O1 of the driver circuit 108 through the pulse selecting circuit 113 and the correction driving pulse Pf again drives the rotor 10. The limiting circuit 116 receives a signal indicating that "the rotation has failed" from the rotation detecting circuit 115 and a signal indicating that "the storage of the execution of the ranking-down operation is cancelled" from the ranking-down storing circuit 138 and therefore, limits the detecting of the impact detecting circuit 114, and the impact detection prohibition time period T3 during which impact detection is not executed, begins. The impact detection prohibition time period T3 continues until a timing s5 that is at the beginning of the subsequent second.

The operations will be described with reference to the flowchart of FIG. 9. The ordinary driving pulse Psn (where "n" is an integer taking a value from 1 to 5) is output at a timing that is at the beginning of a second (step ST51). The rotation detecting circuit 115 executes rotation detection (step ST52). If it is determined that "the rotation is successful" (step ST52: YES), the impact detection is permitted (step ST53). If impact is detected (step ST54: YES), the locking pulse PL is output (step ST55). If impact is not detected (step S54: NO), the operation proceeds to step ST56. It is checked whether the same ordinary driving pulse Psn has maintained the state where "the rotation is successful" for four minutes (step ST56). If the rotation is detected for the four minutes with the same ordinary driving pulse Psn (step ST56: YES), the ranking-down operation is executed by reducing n by one (step ST57). If rotation is not detected (step ST56: NO), the process comes to an end. Indication that the ranking-down operation has been executed is stored to ranking-down storing circuit 138 (step ST58).

On the other hand, if it is determined at step ST52 that no rotation has occurred (step ST52: NO), the correction driving pulse Pf is output (step ST59). It is determined whether indication that the ranking-down operation has been executed is present in the ranking-down storing circuit 138 (step ST60). If indication that the ranking-down operation has been executed is present (step ST60: YES), the impact detection is permitted (step ST61). If impact is detected (step ST62: YES), the locking pulse PL is output (step ST63). If impact is not detected (step ST62: NO), the operation proceeds to step ST64. "n" is again increased by one (step ST64) and therefore, the ordinary driving pulse Psn output at the subsequent timing that is at the beginning of a second is enhanced and storage to the ranking-down storing circuit 138 is cancelled (step ST65).

If storage operation to indicate that the ranking-down operation has been executed is cancelled at step ST60 (step ST60: NO), the impact detection is prohibited (step ST66). The ranking-up operation is executed by increasing n by one (step ST67).

As described, the impact detection is permitted for the first correction driving pulse Pf after the ranking-down operation and the impact is coped with and, when the second and the succeeding correction driving pulses Pf are generated after the ranking-down operation, the impact detection is prohibited and the generation of the locking pulse PL is cancelled. For the correction driving pulse Pf that is generated once in every four minutes due to the ranking-down operation, the impact detection is permitted and the impact is coped with and for the correction driving pulses Pf generated thereafter, the impact detection is prohibited, whereby the impact is coped with and the occurrence of errant hand operation in a magnetic field due to an external magnetic field, is prevented. In the second embodiment, the impact detection is prohibited when the correction driving pulses Pf are consecutively output. Therefore, the impact detection is cancelled when rotor rotation is detected during the output. Therefore, a risk is present that the errant hand operation in a magnetic field occurs. However, in the third embodiment, the impact detection is prohibited only for one session thereof after the ranking-down operation and therefore, the probability of the occurrence of errant hand operation in a magnetic field is further reduced.

As described, the first to the third embodiments each are the configuration for the electronic timepiece on the premise that the timepiece includes one motor and the motor regularly moves every one second. In addition, an electronic timepiece including a type of motor that is not the motor that moves every one second and an electronic timepiece (chronograph) that usually is stopped like a stopwatch and having a hand that is moved by an external operation only when the timepiece is used (for example, a chronograph hand (hereinafter "chrono-hand")) are also present. In these electronic timepieces, the errant hand operation in a magnetic field also needs to be prevented by limiting the output of the locking pulse PL when the correction driving pulse Pf is generated. However, as to the chrono-hand and the hour-hand and the minute-hand that these electronic timepieces have, being different from the first to the third embodiments, when the control is attempted by prohibiting and permitting the output of the locking pulse PL, using the rotation and the non-rotation of the hand, the control is impossible or a long period is necessary until the switching.

In applying the configuration of any of the first to the third embodiments to a chrono-motor 1101 used in a stopwatch function (chronograph), consideration must be given to coping with the risk of errant movement of the hand due to impact occurring while the hand is stopped if the chrono-hand is stopped by user operation while a limitation is put on the output of the locking pulse PL. This movement occurs because a configuration is employed of controlling the prohibition and the permission of the outputting of the locking pulse PL based on the result of the rotation detection of the chrono-hand that is not steadily driven and whose driving and stopping is arbitrarily switched. The presence or absence of the influence of external magnetic field is not able to be determined based on the rotation or the non-rotation of the chrono-hand and therefore, errant movement of the hand occurs.

Figure 10:
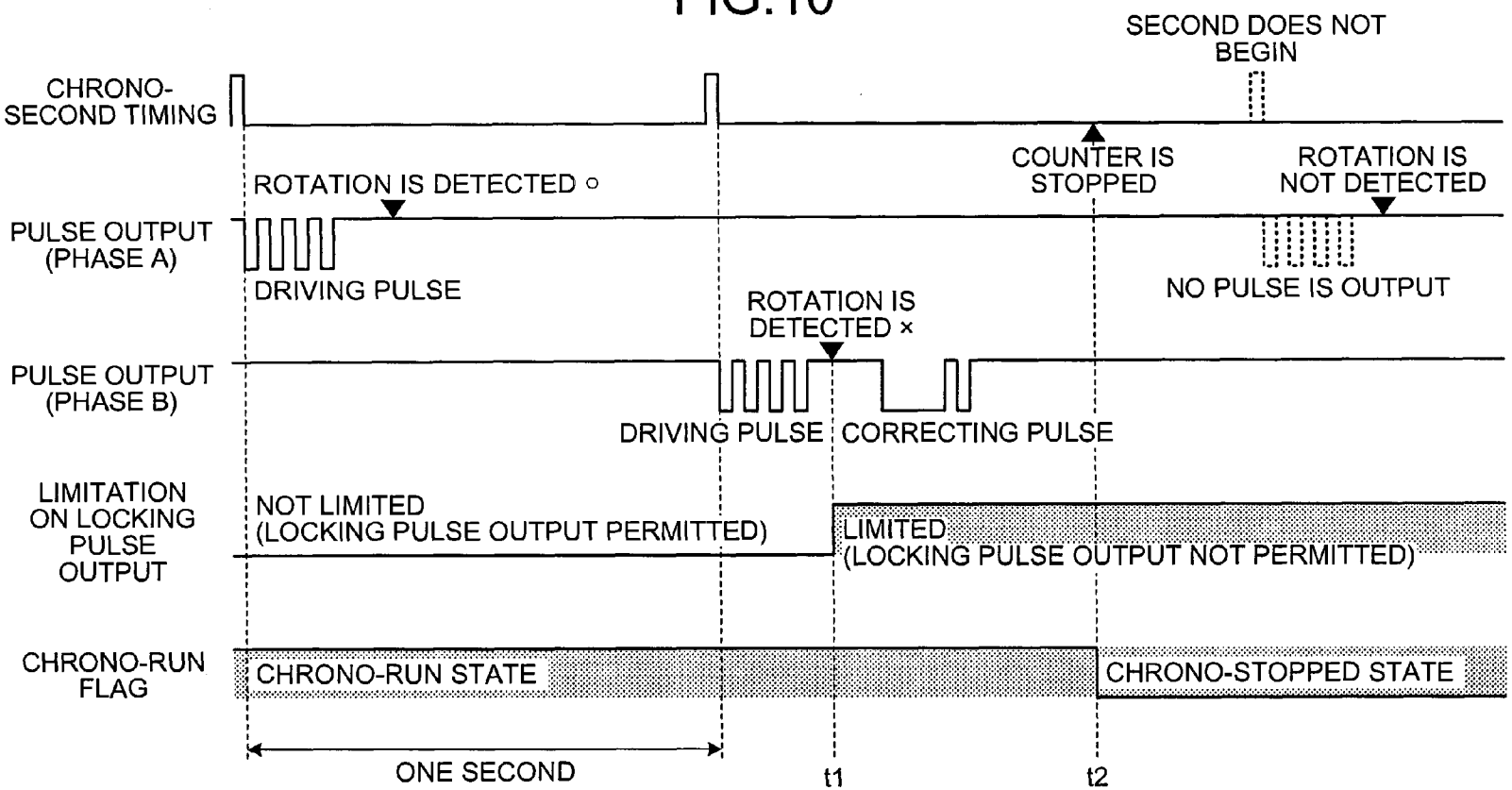
FIG. 10 is a timing chart depicting malfunction of control consequent to a chrono-hand.

FIG. 10 is a timing chart of a malfunction of control consequent to a chrono-hand. The chrono-hand is advanced at the beginning of each second of a chronograph and corresponding to this, driving pulses are output from a phase A and a phase B and are used for the rotation detection. In FIG. 10, if the rotation of the chrono-hand is not detected at a time t1, the output of the correction pulse and the output of the locking pulse are not permitted. More specifically, similar to the first to the third embodiments, this is executed by prohibiting the impact detection. A problem in this case occurs when the chrono-hand is operated to be stopped at a time t2 thereafter, e.g., when the chrono-hand is stopped, a pulse at a timing that is at the beginning of a second is not output and consequently, the rotation detection itself cannot to be executed. In this case, a state where the driving pulse is not output and the limitation on the output of the locking pulse continues (locking pulse outputting is not permitted) thereafter. As described, for a chrono-hand whose advancement is arbitrarily started and stopped, if the chrono-hand is stopped during the time period during which the output of the locking pulse is limited, any opportunity to be able to cancel the limitation on the output of the locking pulse continues to be lost in succeeding time periods and the control becomes impossible.

Similarly, the problem also arises with the configuration to control the prohibition and the permission of the output of the locking pulse PL, based on the result of the rotation detection of a hand whose hand-operation cycle is long (for example, 20 seconds) such as an hour- or a minute-hand. Once the rotation detecting circuit 115 detects the non-rotation, the detection of any impact and output of the locking pulse PL are prohibited for 20 seconds until the next driving pulse is output and therefore, the motor remains unprotected against impact for a long time. Thus, how the risk of errant hand movement due to impact occurring during such a state is to be coped with must be considered.

When a magnetic field detecting unit (for example, a Hall element) that directly detects an external magnetic field applied to an electronic timepiece may be incorporated therein and may be used as a simple countermeasure against the above phenomenon. The timepiece merely has to be configured to prohibit the impact detection during the time period during which the magnetic field detecting unit detects an external magnetic field. The timepiece may also be configured to control the prohibition and the permission of the impact detection by an operation using an external operation member.

Embodiments (Fourth to Sixth Embodiments) each having a configuration to control the prohibition and the permission of the output of the locking pulse PL regardless of the rotation and the non-rotation of the hand will be described below.

Fourth Embodiment

A fourth embodiment of the present invention is an electronic timepiece that has a chronograph function and that is configured to cause the limitation on the output of the locking pulse PL to come to an end after a predetermined time period has elapsed as indicated by a time counting signal separately prepared.

Figure 11:
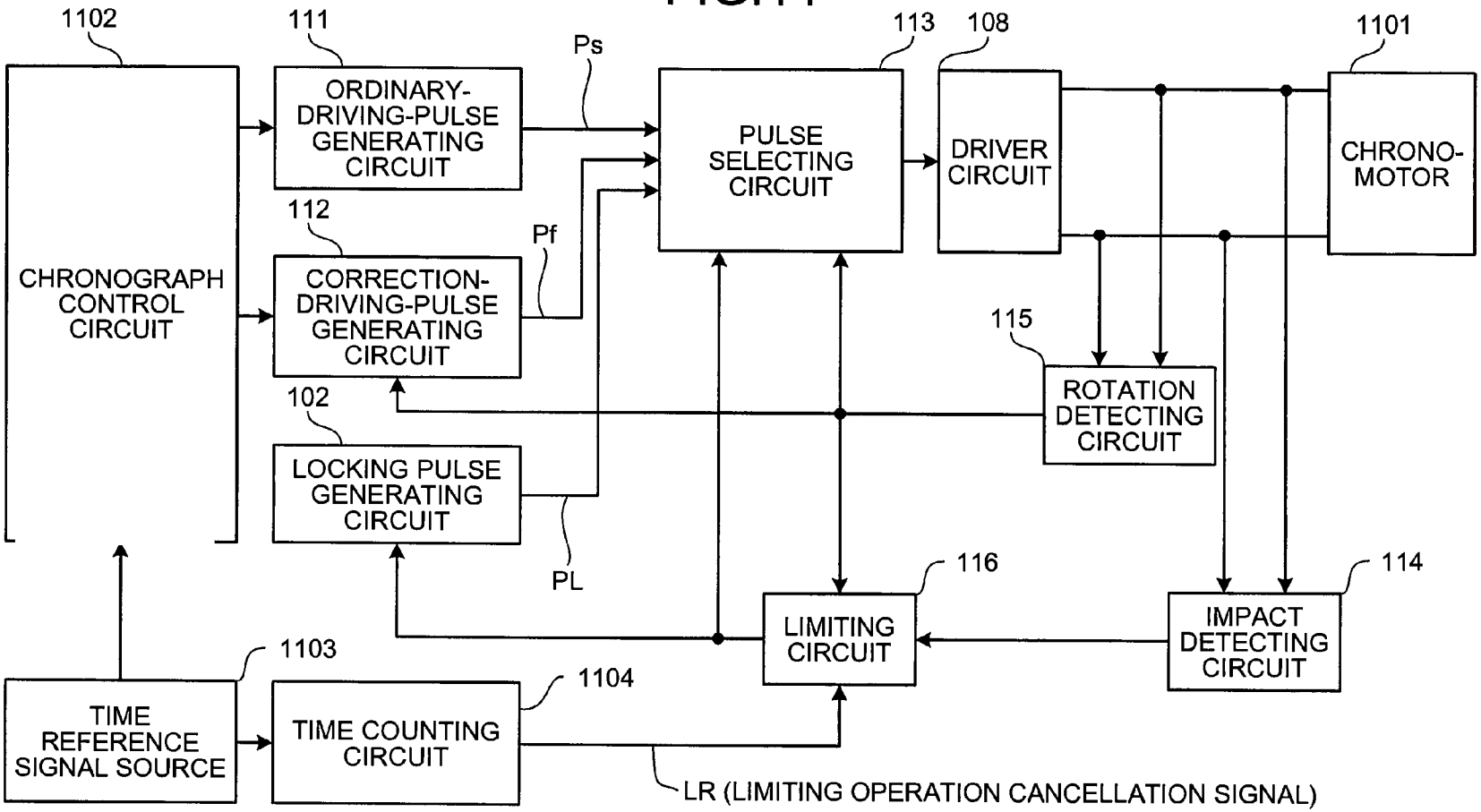
FIG. 11 is a block diagram of a circuit configuration of the electronic timepiece having a chronograph function according to a fourth embodiment.

FIG. 11 is a block diagram of a circuit configuration of the electronic timepiece having the chronograph function according to the fourth embodiment of the present invention. As depicted in FIG. 11, the electronic timepiece having the chronograph function includes the chronograph motor (hereinafter, "chrono-motor") 1101, the ordinary-driving-pulse generating circuit 111, the correction-driving-pulse generating circuit 112, the locking pulse generating circuit 102, the pulse selecting circuit 113, the driver circuit 108, the rotation detecting circuit 115, the impact detecting circuit 114, the limiting circuit 116, a chronograph control circuit 1102, a time reference signal source 1103, and a time counting circuit 1104. Components similar to those described in the example of the conventional art and the first embodiment are given the same reference numerals used in the respective descriptions and will not again be described.

The chrono-motor 1101 is configured by a rotor and a coil and rotates the chrono-hand. The chrono-motor 1101 is driven through the driver circuit 108 by a motor driving pulse output by the pulse selecting circuit 113. The pulse selecting circuit 113 is connected to the ordinary-driving-pulse generating circuit 111, the correction-driving-pulse generating circuit 112, and the locking pulse generating circuit 102, and from among the ordinary driving pulse Ps, the correction driving pulse Pf, and the locking pulse PL, selects and outputs any one of the motor driving pulses.

The chronograph control circuit 1102 manages the time counting and the control of the chronograph function. Based on a signal of the chronograph control circuit 1102, the ordinary-driving-pulse generating circuit 111 and the correction-driving-pulse generating circuit 112 each generates a pulse according to the operation of the chronograph. Usually, during the chronograph operation, the chrono-motor 1101 is driven by the ordinary driving pulse Ps. If the rotation detecting circuit 115 detects the non-rotation of the chrono-motor 1101, the chrono-motor 1101 is securely driven by the correction driving pulse Pf.

If the chrono-motor 1101 is subject to impact and deviation from the designated value may have occurred, the impact detecting circuit 114 detects the impact and the locking pulse generating circuit 102 operates. Thereby, the locking pulse PL is output and deviation of the designated value is prevented in advance.

If the rotation detecting circuit 115 detects non-rotation of the chrono-motor 1101, the chrono-motor may be present in a magnetic field and malfunction of the impact detecting circuit 114 and deviation of the designated value due to the output of the locking pulse PL may occur. Therefore, the limiting circuit 116 limits the detecting operation of the impact detecting circuit 114 or the output of the pulse of the locking pulse generating circuit 102 and thereby, deviation of the designated value is prevented in advance.

If the rotation detecting circuit 115 detects rotation of the chrono-motor 1101, it is considered that the chrono-motor 1101 is out of the magnetic field and therefore, the limitation on the detecting operation of the impact detecting circuit 114 or the limitation on the output of the pulse of the locking pulse generating circuit 102 imposed by the limiting circuit 116 is cancelled.

In the above configuration, as described with reference to FIG. 10, when the operation state of the chronograph controlled by the chronograph control circuit is a stopped state, the output of the pulse to the chrono-motor 1101, that is, an operation to detect the rotation of the chrono-motor 1101 may not be executed for a long time. Therefore, providing for a case where the rotation detecting operation is not executed for a long time, the time counting circuit 1104 measures the operating time of the limiting circuit 116, outputs a limiting operation cancellation signal LR to the limiting circuit 116 and thereby, after a predetermine time period, cancels the limitation on the detecting operation of the impact detecting circuit 114 or the limitation on the output of the pulse of the locking pulse generating circuit 102 imposed by the limiting circuit 116.

The time counting circuit 1104 measures the operation time of the limiting circuit 116. The time that is measured by the time counting circuit 1104 is continuously counted regardless of the time that is measured by the chronograph and therefore, the measuring operation of the time counting circuit 1104 does not stop even when the operation of the chronograph stops. The predetermined time period measured by the time counting circuit 1104 is arbitrary and therefore, a configuration to measure the predetermined time period using a time counting signal does not need to be employed. For example, for the electronic timepiece according to any of the first to the third embodiments that are based on the premise that the motor keeps on moving every one second, in an experiment, the state where a pulse was generated causing the rotor of the motor to rotate by 360 degrees was cancelled after, at most, one second had elapsed when the next driving pulse was output. Therefore, the control circuit may be simplified by configuring the control circuit to cancel the prohibition of the output of the locking pulse PL at the time when "1 Hz" of a current-time signal has been counted twice.

Figure 12:
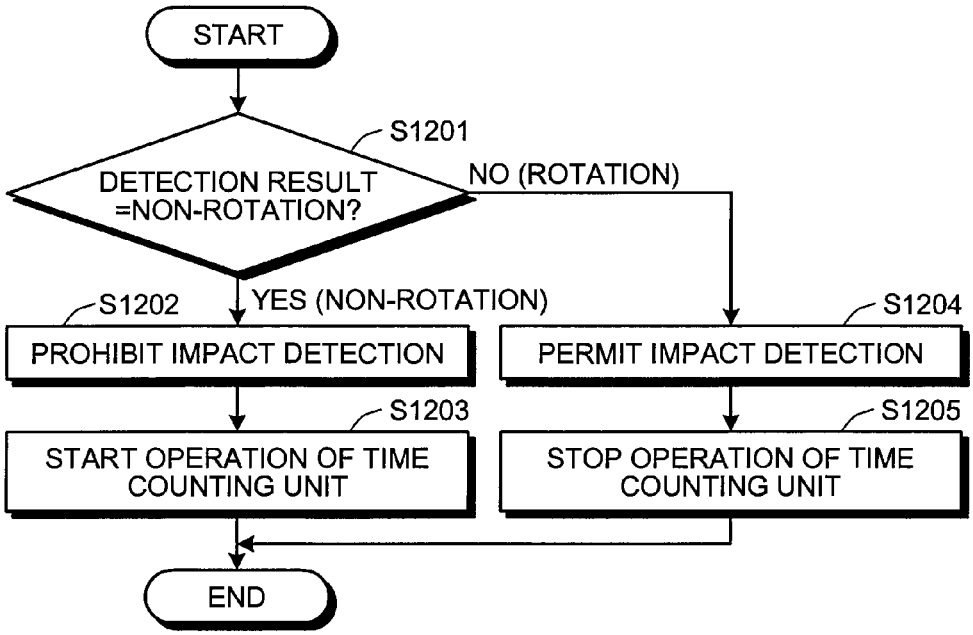
FIG. 12 is a flowchart depicting the processes of the electronic timepiece having the chronograph function according to the fourth embodiment (part 1)

Details of processes executed by the electronic timepiece having the chronograph function according to the fourth embodiment of the present invention will be described. FIG. 12 is a flowchart of the processes of the electronic timepiece having the chronograph function according to the fourth embodiment. Concerning details of the processes executed by the electronic timepiece having the chronograph function, FIG. 12 depicts operations according to each rotation detection result obtained by the rotation detecting circuit 115 and processes executed for each operation of the rotation detecting circuit 115.

As depicted in the flowchart of FIG. 12, it is determined whether the result of the rotation detection of the rotation detecting circuit 115 is "non-rotation" (step S1201). If it is determined that the result of the rotation detection is "non-rotation" (step S1201: YES), the detecting operation of the impact detecting circuit 114 is prohibited by the limiting circuit 116 (step S1202). An operation of the time counting circuit 1104 is started (step S1203) and the series of processes come to an end.

When it is determined at step S1201 that the result of the rotation detection is "rotation" (step S1201: NO), the detecting operation of the impact detecting circuit 114 is permitted by the limiting circuit 116 (step S1204). The operation of the time counting circuit 1104 is stopped (step S1205) and the series of processes comes to an end.

Figure 13:
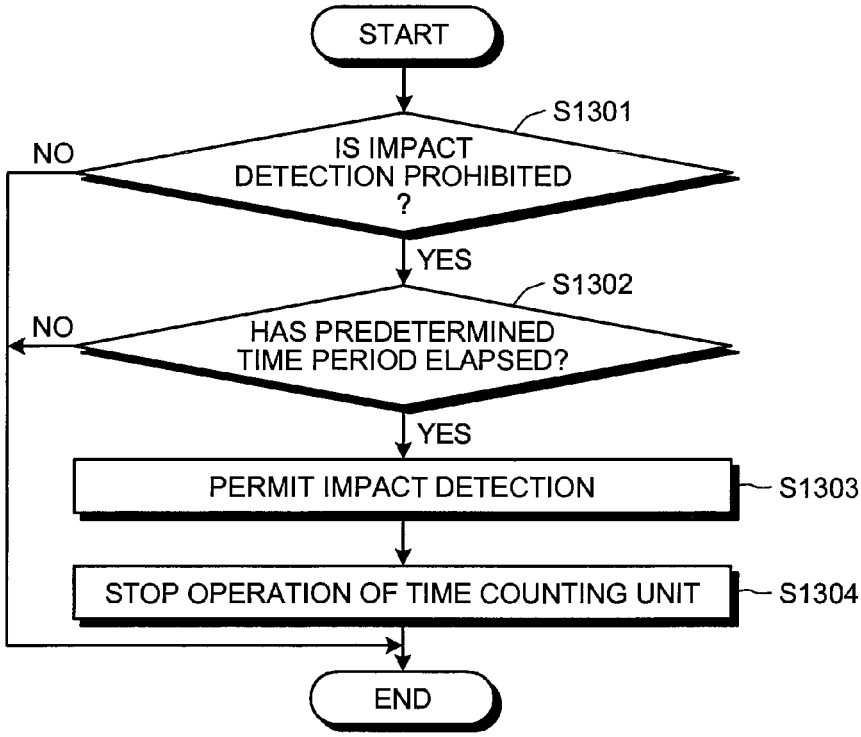
FIG. 13 is a flowchart depicting processes executed by the electronic timepiece having the chronograph function according to the fourth embodiment (part 2)

FIG. 13 is a flowchart of processes executed by the electronic timepiece having the chronograph function. Concerning details of the processes executed by the electronic timepiece having the chronograph function, FIG. 13 depicts constant processes that are continuously executed.

As depicted in the flowchart of FIG. 13, it is determined whether the detecting operation of the impact detecting circuit 114 is prohibited by the limiting circuit 116 (step S1301). If it is determined that the detecting operation of the impact detecting circuit 114 is not prohibited (step S1301: NO), the process comes to an end. If it is determined that the detecting operation of the impact detecting circuit 114 is prohibited (step S1301: YES), the counted time of the time counting circuit 1104 is checked and thereby, it is determined whether a predetermined time period has elapsed of the time period to prohibit the impact detection (step S1302).

If it is determined at step S1302 that the predetermined time period has not elapsed (step S1302: NO), the series of processes come to an end. If it is determined that the predetermined time period has elapsed (step S1302: YES), the detecting operation of the impact detecting circuit 114 is permitted by the limiting circuit 116 (step S1303). The operation of the time counting circuit 1104 is stopped (step S1304) and the series of processes comes to an end.

Figure 14:
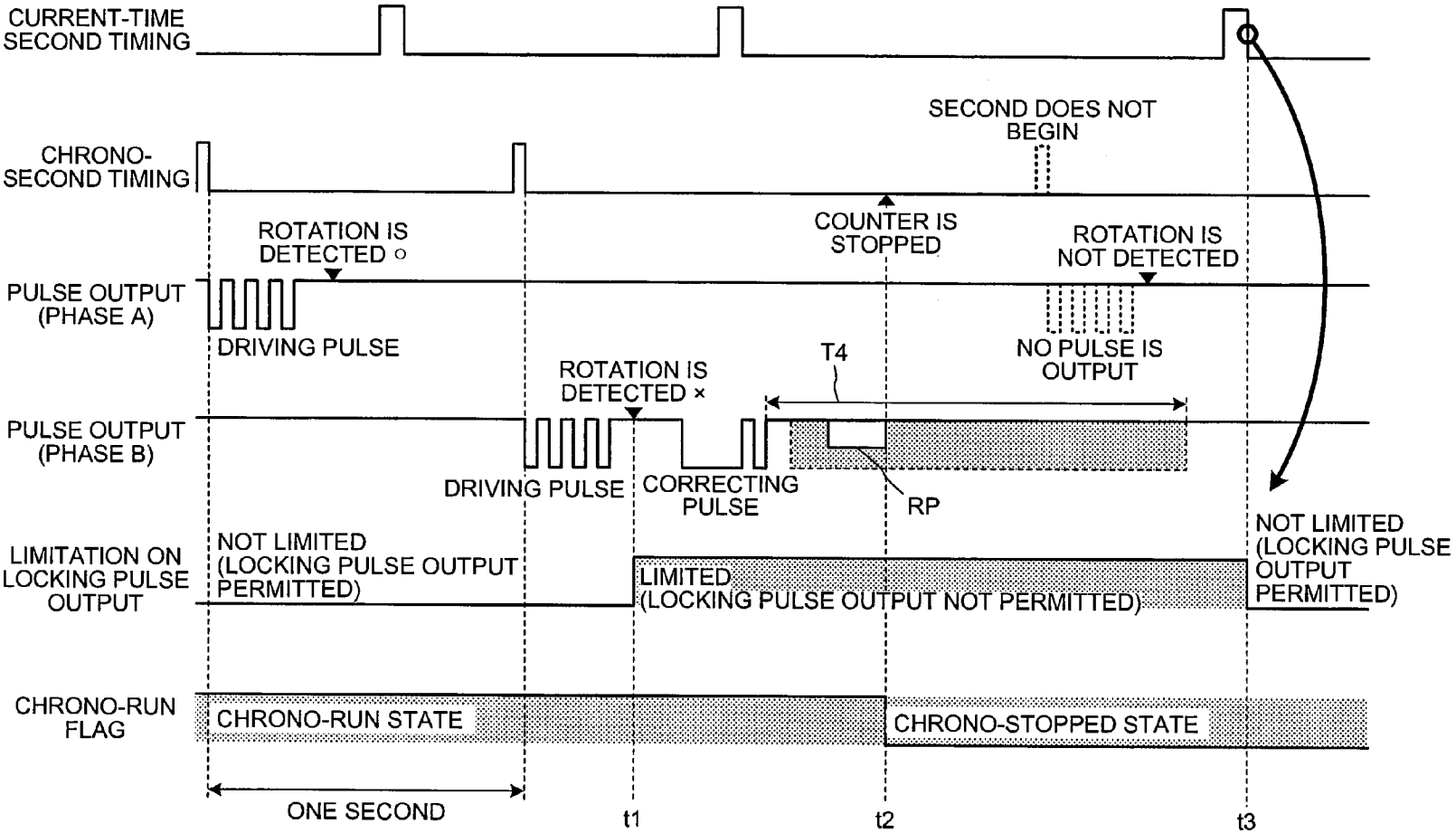
FIG. 14 is a timing chart depicting a canceling operation of a limitation on the output of the locking pulse according to the fourth embodiment.

FIG. 14 is a timing chart of the canceling operation of the limitation on the output of the locking pulse according to the fourth embodiment. As depicted in the upper portion of FIG. 14, at a current-time second timing, i.e., at the beginning of each current-time second, a pulse is output regardless of the operation of the chrono-hand. Hereinafter, similarly in FIG. 10, it is assumed that it is determined at the time t1 that the rotation of the chrono-hand is not detected and the chrono-hand is operated to be stopped at the time t2. Thereby, the limitation on the output of the locking pulse is maintained as it is (locking-pulse output is not permitted). However, the limitation on the output of the locking pulse is cancelled at the beginning of the next second and that arrives at the time t3. Thereby, thereafter, the output of the locking pulse is permitted. In the configuration, even when a 360-degree-rotation pulse (RP in FIG. 14) is irregularly generated after the time t1, this pulse comes to an end within one second (a section T4) and therefore, no problem arises even if the limitation on the locking pulse is cancelled at the beginning of the next current-time second timing.

As described, according to the electronic timepiece of the fourth embodiment, the predetermined time period may be counted by the time counting circuit 1104 and the prohibition of the outputting of the locking pulse PL may be cancelled after the predetermined time period has elapsed. More specifically, when the time counting circuit 1104 that counts time at the beginning of the current-time second generated regardless of the chronograph, measures a given time period after the limitation on the output of the locking pulse PL has been operated, the operation of the limitation on the output of the locking pulse PL is caused to come to an end, without waiting for the detection of any rotation. More specifically, the prohibition of the impact detection is cancelled and the impact detecting operation is permitted as usual. Thereby, the operation of the limitation on the output of the locking pulse PL is held to a minimum regardless of the state of the chronograph that is operating or stopped. Therefore, degradation is prevented of the braking function of the chrono-motor 1101 caused by a long perpetuation of the state where the output of the locking pulse is limited.

Although the fourth embodiment has been described taking the example of the chrono-hand, the fourth embodiment may also be applied to the hour-hand, the minute-hand, etc. The fourth embodiment may also be applied to a configuration including one motor (a two-hand timepiece).

Fifth Embodiment

An embodiment will be described of an electronic timepiece that has two motors and that causes the operation of the limitation on the output of the locking pulse to come to an end when a rotation detecting circuit of either one of a first and a second motors detects a rotation of the motor. In a fifth embodiment, an electronic timepiece having the chronograph function will be described that has a configuration to control the limitation on the outputting of the locking pulse of the second motor that operates intermittently or at long intervals, based on the result of rotation detection of the first motor that operates steadily and at short intervals.

Figures 1, 15:
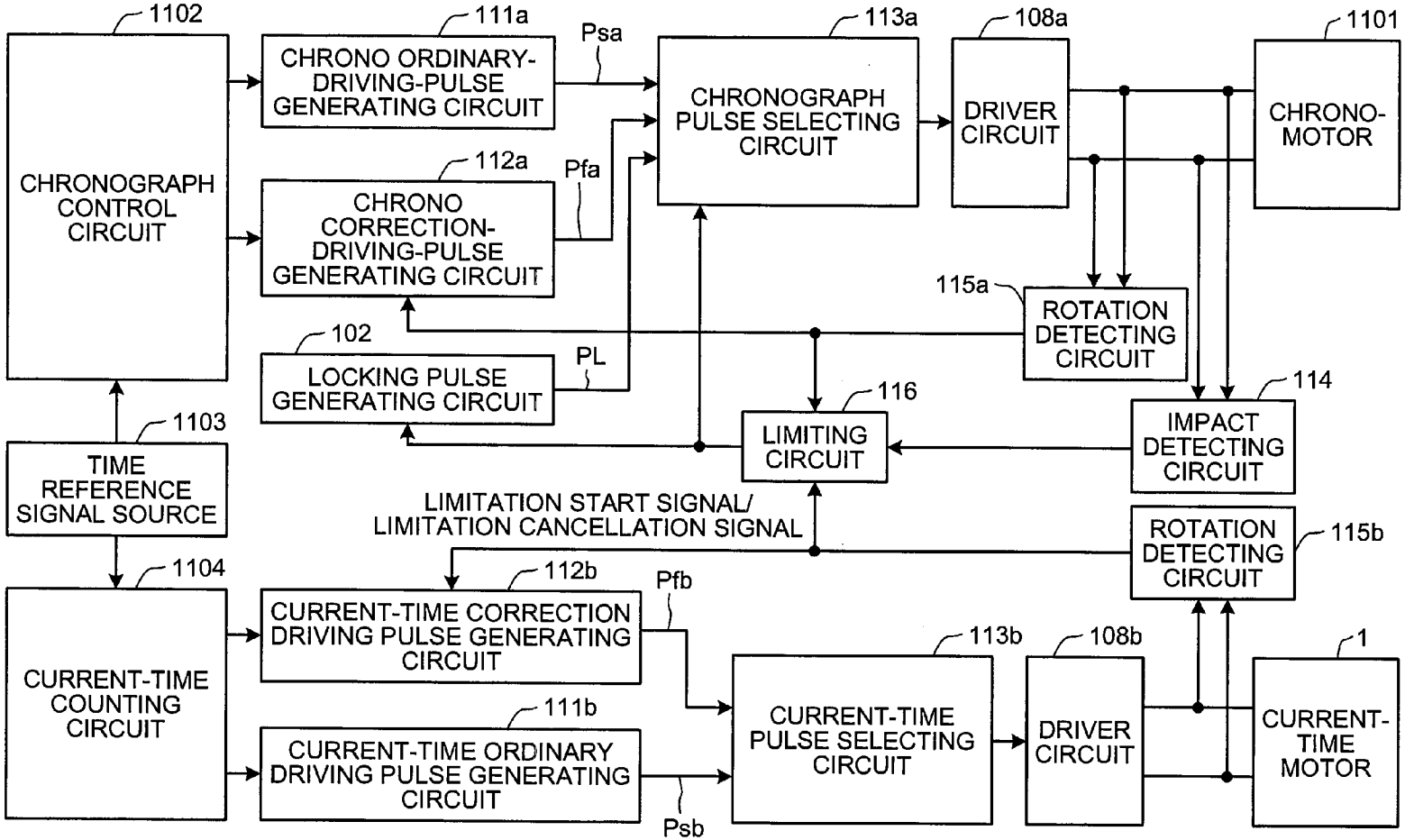
Figures 2, 15:
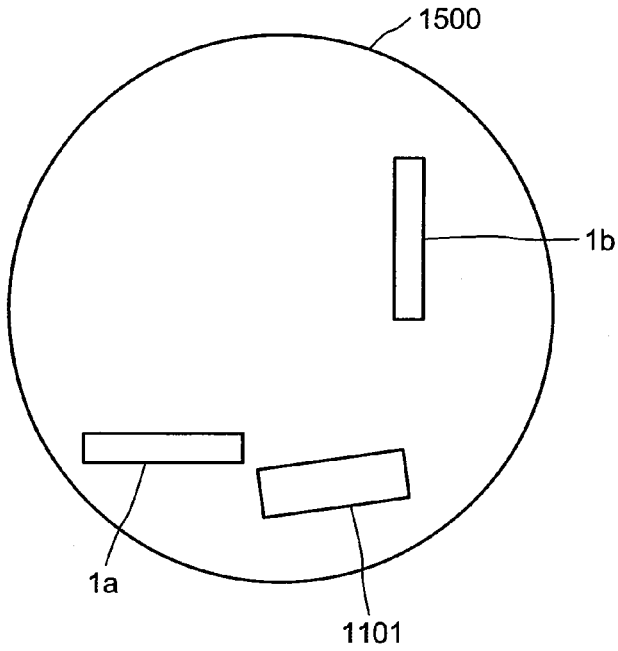

FIG. 15-1 is a block diagram of a circuit configuration of the electronic timepiece having the chronograph function according to the fifth embodiment. In FIG. 15-1, the electronic timepiece having the chronograph function according to the fifth embodiment includes the two motors that are the first motor referred to as "current-time motor 1" and the second motor referred to as "chrono-motor 1101". The braking function based on the impact detection is included only in the chrono-motor 1101. The current-time motor 1 counts the current-time and is same as the stepper motor 1 of the first embodiment.

Preferably, in the electronic timepiece according to the fifth embodiment, the longitudinal direction of each of the two motors is disposed substantially parallel to each other because each of the two motors mutually uses the other motor as an external-magnetic sensor. This is because, in the phenomenon of the errant hand operation, the direction of an external magnetic field that causes the phenomenon is determined and therefore, because the two motors need to be in the same condition for the external magnetic field. FIG. 15-2 is a diagram of an exemplary disposition of the chrono-motor and the current-time motor. For example, when the chrono-motor 1101 is disposed at a position indicated in FIG. 15-2 in a timepiece 1500, to achieve the effect of this embodiment, preferably, the longitudinal direction of the current-time motor 1 is disposed in substantially parallel ("1*a*" in FIG. 15-2) to that of the chrono-motor 1101 and preferably, is not disposed substantially perpendicular ("1*b*" in FIG. 15-2) to the longitudinal direction of the chrono-motor 1101.

Roughly dividing the electronic timepiece having the chronograph function according to the fifth embodiment depicted in FIG. 15-1 into two, control circuits on the chronograph side thereof and control circuits on the current-time-counting side thereof are disposed parallel to each other. Components similar to those described in the above embodiments are given the same reference numerals used therein appended with subscripts (a, b) and will not again be described.

A circuit depicted in FIG. 15-1 includes a chrono-ordinary-driving-pulse generating circuit 111*a*, a current-time-ordinary-driving-pulse generating circuit 111*b*, a chrono-correction-driving-pulse generating circuit 112*a*, a current-time-correction-driving-pulse generating circuit 112*b*, the locking pulse generating circuit 102, a chronograph pulse selecting circuit 113*a*, a current-time pulse selecting circuit 113*b*, driver circuits 108*a* and 108*b*, rotation detecting circuits 115*a* and 115*b*, the impact detecting circuit 114, the limiting circuit 116, the chronograph control circuit 1102, the (current time) counting circuit 1104, and the time reference signal source 1103.

The chronograph pulse selecting circuit 113*a* is connected to the chrono-ordinary-driving-pulse generating circuit 111*a*, the chrono-correction-driving-pulse generating circuit 112*a*, and the locking pulse generating circuit 102, and from among a chrono-ordinary driving pulse Psa, a chrono-correction driving pulse Pfa, and the locking pulse PL, selects and outputs any one of the motor driving pulses. The chrono-motor 1101 is driven by the motor driving pulse through the driver circuit 108*a*. Each of the pulse generating circuits 111*a* and 112*a* generates a pulse that corresponds to an operation of the chronograph based on a signal of the chronograph control circuit that manages the time counting and control of the chronograph function.

On the other hand, the current-time pulse selecting circuit 113*b* is connected to the current-time-ordinary-driving-pulse generating circuit 111*b* and the current-time-correction-driving-pulse generating circuit 112*b*, and from among a current-time ordinary driving pulse Psb and a current-time correction driving pulse Pfb, selects and outputs any one of the motor driving pulses. The current-time motor 1 is driven by the motor driving pulse through the driver circuit 108*b*. Each of the pulse generating circuits 111*b* and 112*b* regularly generates the motor driving pulse based on a signal of the current-time counting circuit 1104 that counts the current time.

Both the chrono-motor 1101 and the current-time motor 1 usually are driven by the ordinary driving pulses Psa and Psb. If the rotation detecting circuits 115*a* and 115*b* detect non-rotation of the motors 1101 and 1, the motors 1101 and 1 are securely driven by the correction driving pulses Pfa and Pfb.

If the chrono-motor 1101 sustains impact and the designated value may deviate, the impact detecting circuit 114 detects the impact and the locking pulse generating circuit 102 operates. Thereby, the locking pulse is output and deviation of the designated value is prevented in advance.

If the rotation detecting circuit 115*a* detects the non-rotation of the chrono-motor 1101, the chrono-motor 1101 may be present in a magnetic field, and malfunction of the impact detecting circuit 114 and deviation of the designated value due to the output of the locking pulse PL may occur. Therefore, the limiting circuit 116 limits the detecting operation of the impact detecting circuit 114 or the output of the pulse of the locking pulse generating circuit 102 and thereby, deviation of the designated value is prevented in advance.

If the rotation detecting circuit 115*a* detects the rotation of the chrono-motor 1101, it is considered that the chrono-motor 1101 is out of the magnetic field and therefore, the limitation on the detecting operation of the impact detecting circuit 114 or the limitation on the output of the pulse of the locking pulse generating circuit 102 imposed by the limiting circuit 116 is cancelled.

In this case, if the operation state of the chronograph controlled by the chronograph control circuit 1102 is the stopped state, the output of the pulse to the chrono-motor 1101, that is, the rotation detecting operation may not be executed for a long time. Therefore, if the rotation detecting operation is not executed for a long time, the detecting operation of the impact detecting circuit 114 is controlled by the limiting circuit 116, based on the result of the rotation detection by the rotation detecting circuit 115*b* of the current-time motor 1 that steadily operates.

Figure 16:
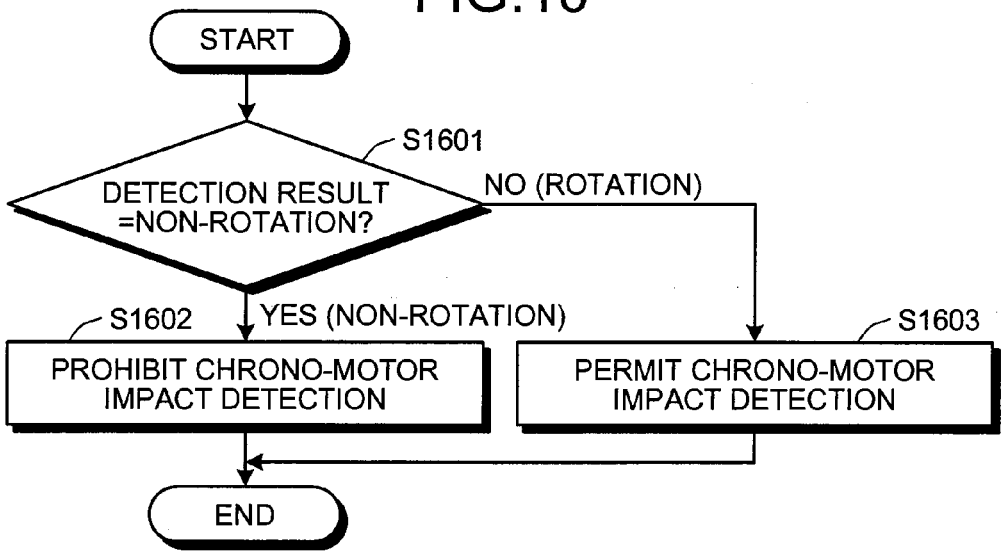
FIG. 16 is a flowchart depicting processes of the electronic timepiece having the chronograph function according to the fifth embodiment (part 1)

Details of the processes of the electronic timepiece having the chronograph function according to the fifth embodiment will be described. FIG. 16 is a flowchart of the processes of the electronic timepiece having the chronograph function according to the fifth embodiment. Concerning details of the processes of the electronic timepiece having the chronograph function, FIG. 16 depicts the operations for the results of the rotation detection of the rotation detecting circuit 115*a* of the chrono-motor 1101 and a process is executed for an operation of the rotation detecting circuit 115*a* of the chrono-motor 1101.

In the flowchart of FIG. 16, it is determined whether the result of the rotation detection of the rotation detecting circuit 115*a* of the chrono-motor 1101 is "non-rotation" (step S1601). If it is determined that the result of the rotation detection is "non-rotation" (step S1601: YES), the limiting circuit 116 prohibits the detecting operation of the impact detecting circuit 114 (step S1602). Thereby, the series of processes comes to an end.

If it is determined at step S1601 that the result of the rotation detection is "rotation" (step S1601: NO), the limiting circuit 116 permits the detecting operation of the impact detecting circuit 114 (step S1603). Thereby, the series of processes come to an end.

Figure 17:
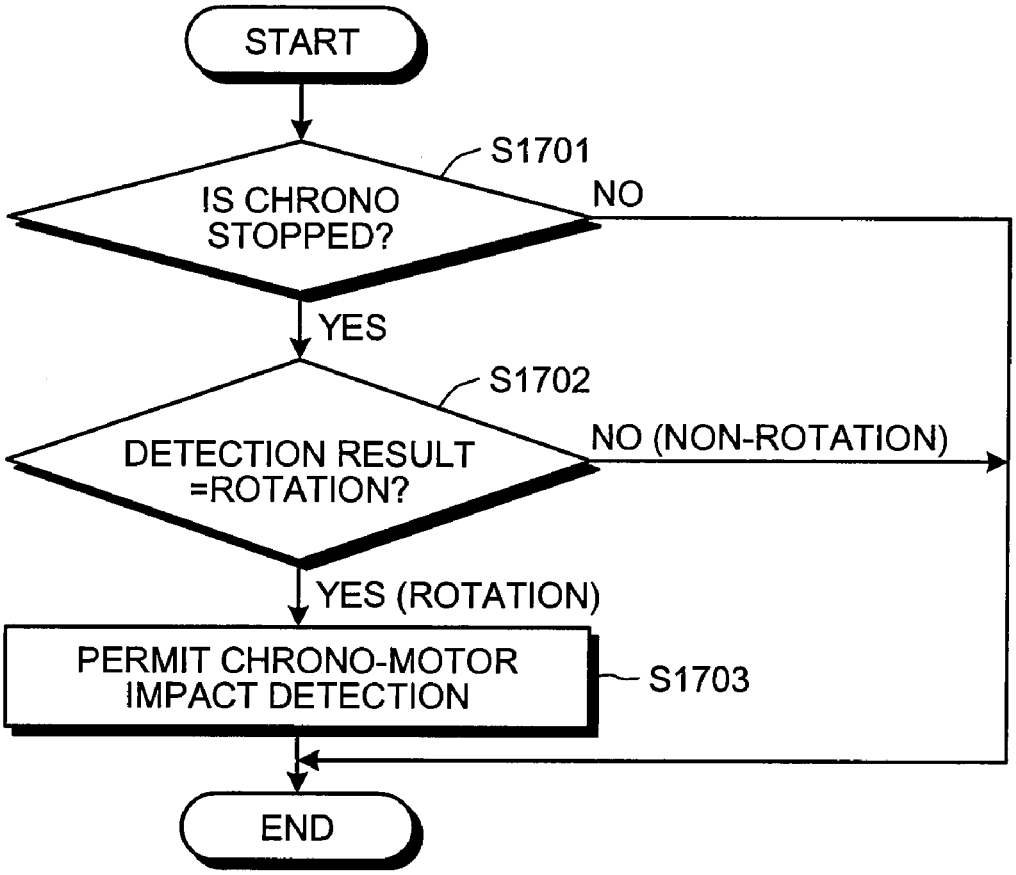
FIG. 17 is a flowchart depicting the processes of the electronic timepiece having the chronograph function according to the fifth embodiment (part 2)

FIG. 17 is a flowchart of the processes of the electronic timepiece having the chronograph function. Concerning details of the processes of the electronic timepiece having the chronograph function, FIG. 17 depicts the operations for the results of the rotation detection of the rotation detecting circuit 115*b* of the current-time motor 1 and a process is executed for an operation of the rotation detecting circuit 115*b* of the current-time motor 1.

As depicted in the flowchart of FIG. 17, it is determined whether the operation state of the chronograph by the chronograph control circuit 1102 is a stopped state (step S1701). If it is determined that the operation state of the chronograph is an operating state (step S1701: NO), the process comes to an end. If it is determined that the operation state of the chronograph is a stopped state (step S1701: YES), it is determined whether the result of the rotation detection of the rotation detecting circuit 115*b* of the current-time motor 1 is "rotation" (step S1702).

If it is determined at step S1702 that the result of the rotation detection is "non-rotation" (step S1702: NO), the series of processes comes to an end. If it is determined that the result of the rotation detection is "rotation" (step S1702: YES), the detecting operation of the impact detecting circuit 114 is permitted by the limiting circuit 116 (step S1703) and the series of processes comes to an end.

Figure 18:
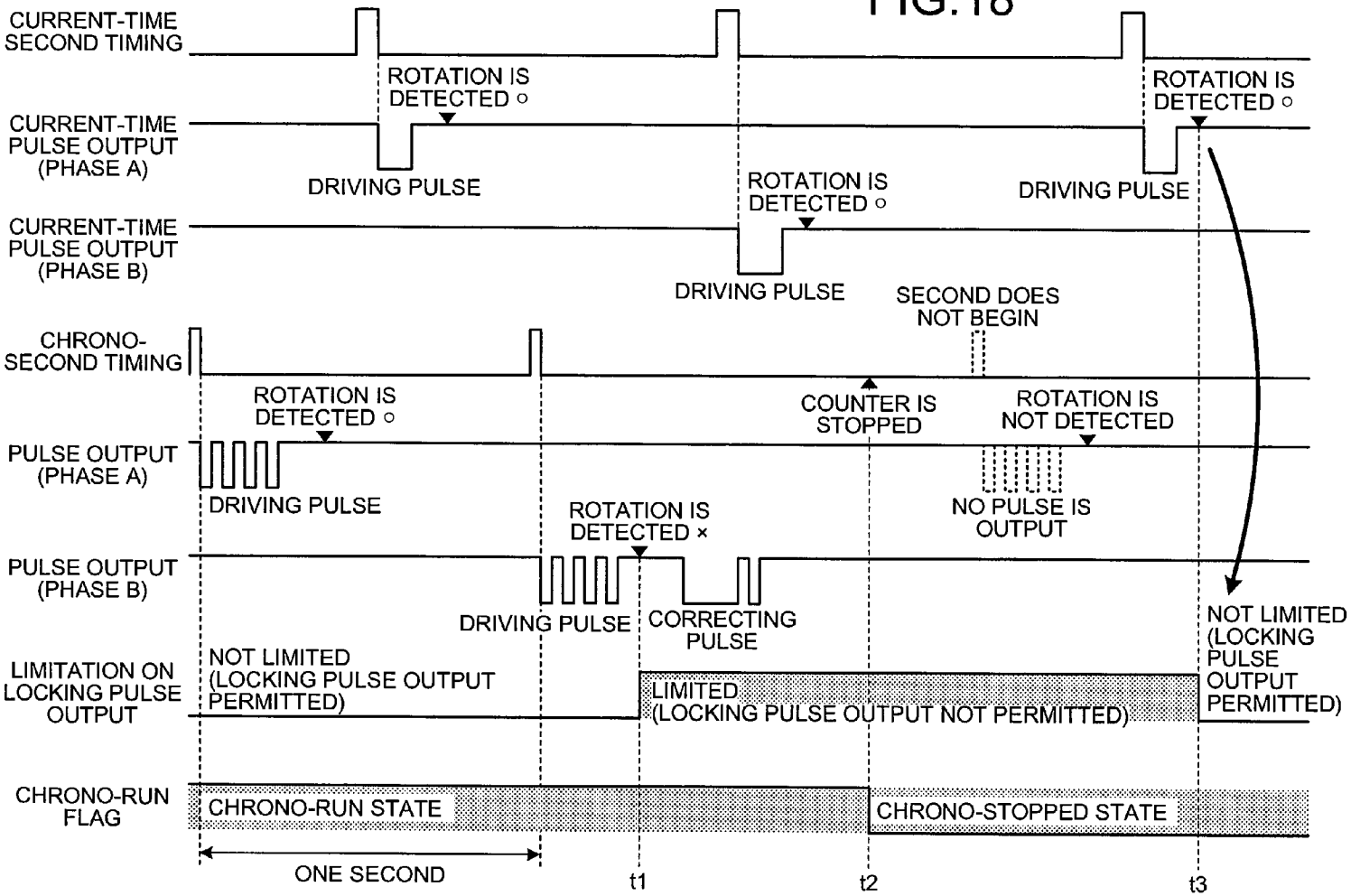
FIG. 18 is a timing chart of the canceling operation of the limitation on the output of the locking pulse according to the fifth embodiment.

FIG. 18 is a timing chart of the canceling operation of the limitation on the output of the locking pulse according to the fifth embodiment. Similarly to FIG. 14, it is assumed that it is determined at the time t1 that the rotation of the chrono-hand is not detected and the chrono-hand is operated to be stopped at the time t2. Thereby, the limitation on the output of the locking pulse is maintained as it is (non-permission of the output of the locking pulse). However, if a current-time pulse is output and rotation is detected at the time t3, the limitation on the output of the locking pulse is cancelled based on this detection of rotation. Thereby, thereafter, the output of the locking pulse is permitted.

Sixth Embodiment

A sixth embodiment is configured to start the operation of limiting the output of the locking pulse when the rotation detecting unit of either one of the first and the second motors detects non-rotation of the motor. More specifically, the sixth embodiment has a configuration to limit the output of the locking pulse to the chrono-motor 1101 (to prohibit the impact detection) by having detected the non-rotation of the current-time motor 1. Details of the processes of an electronic timepiece according to the sixth embodiment will be described.

Figure 19:
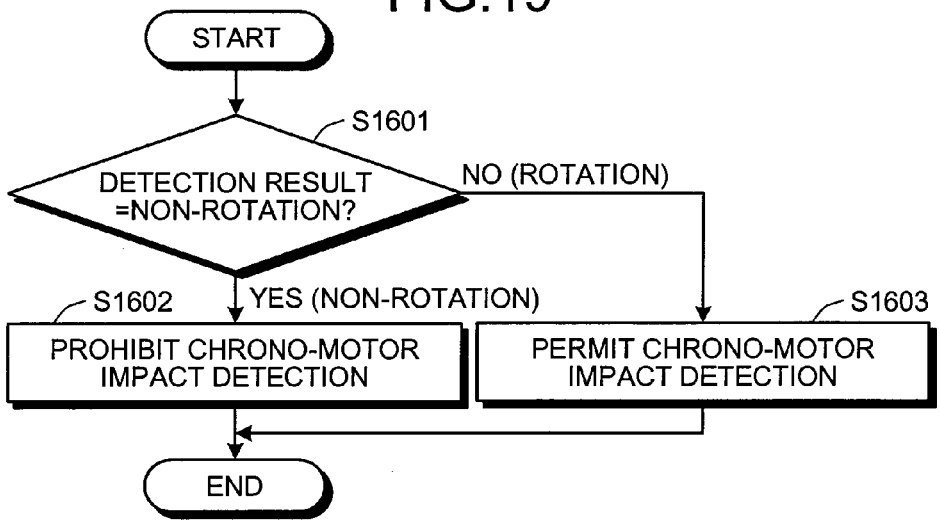
FIG. 19 is a flowchart depicting the processes of the electronic timepiece according to a sixth embodiment (part 1)
Figure 20:
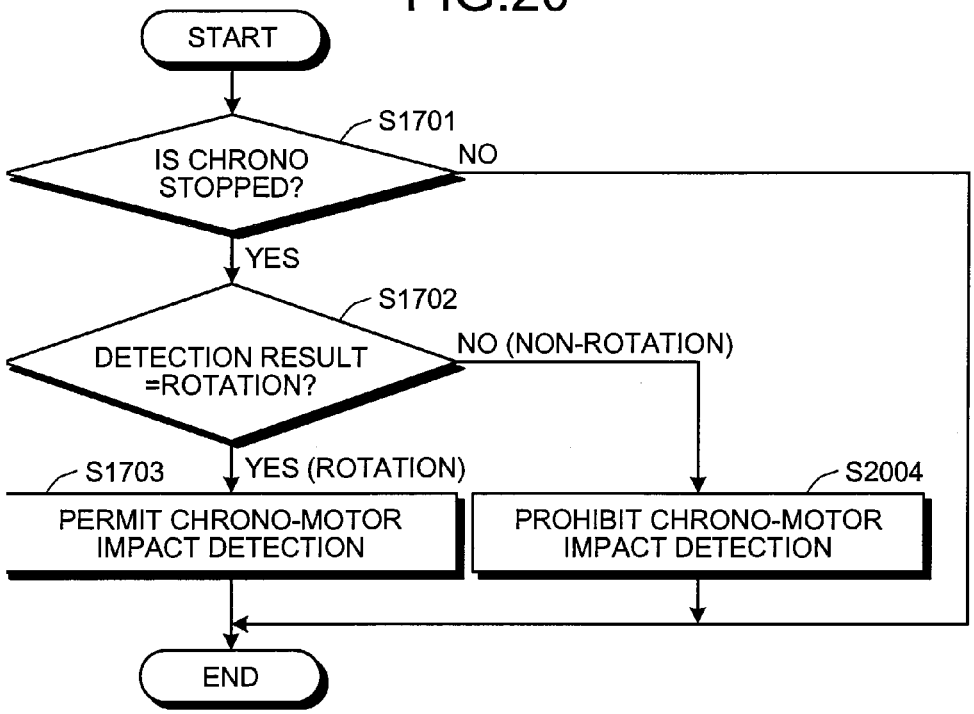
FIG. 20 is a flowchart depicting the processes of the electronic timepiece having the chronograph function according to the sixth embodiment (part 2)
Figure 21:
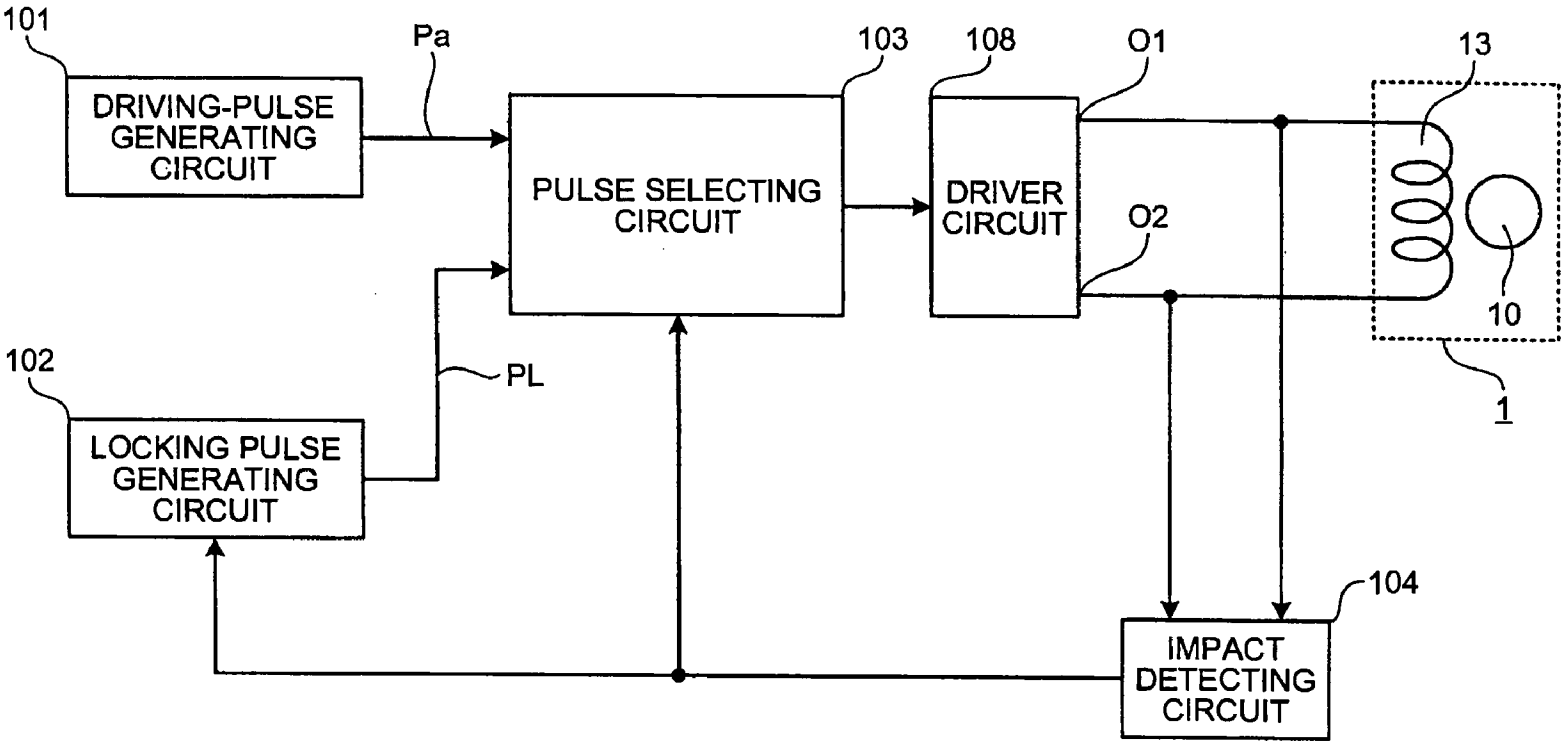
FIG. 21 is a block diagram of a configuration of a conventional electronic timepiece.
Figure 22:
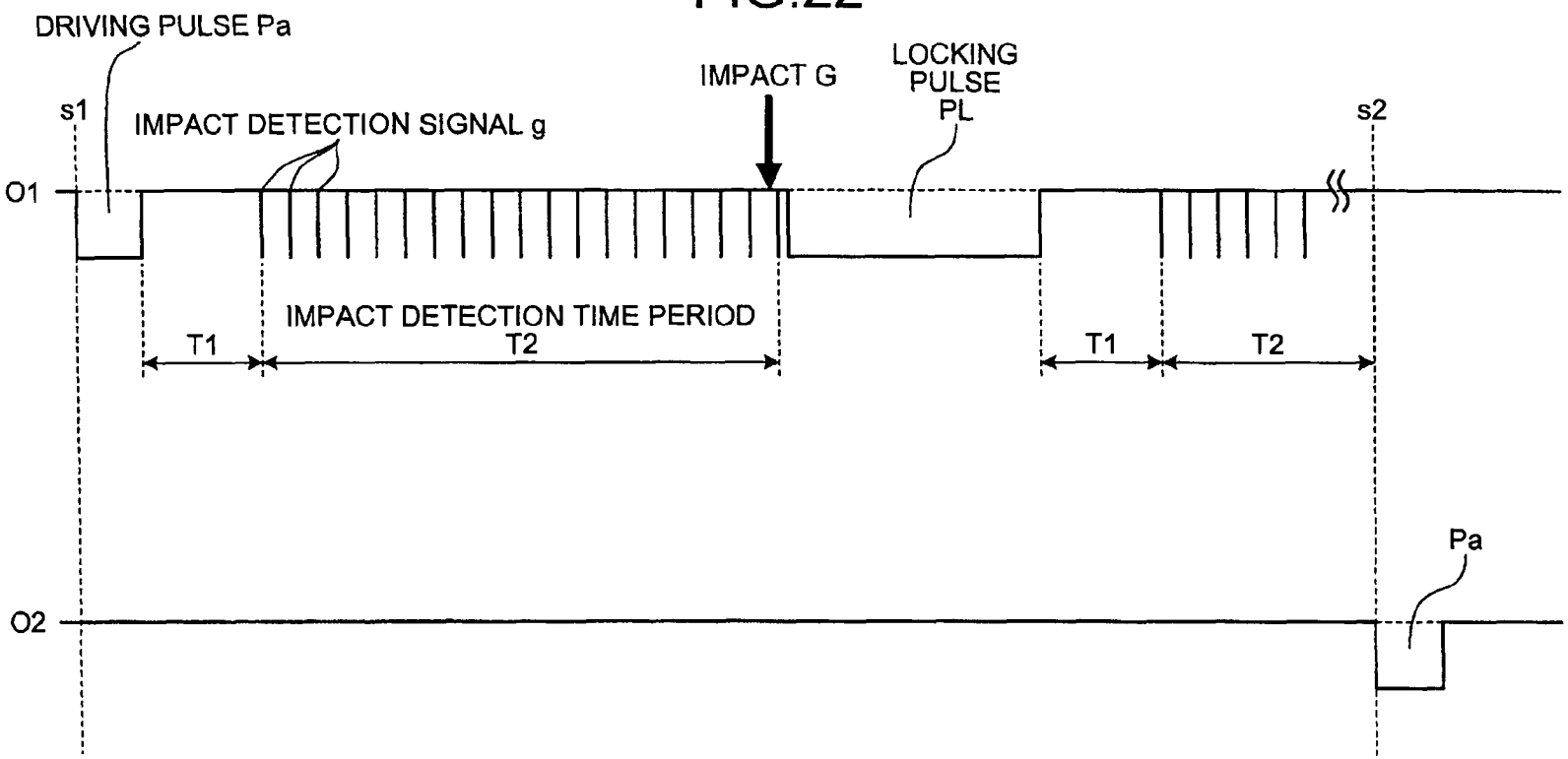
FIG. 22 is a wave diagram for explaining circuit operation of the conventional electronic timepiece.
Figure 23:
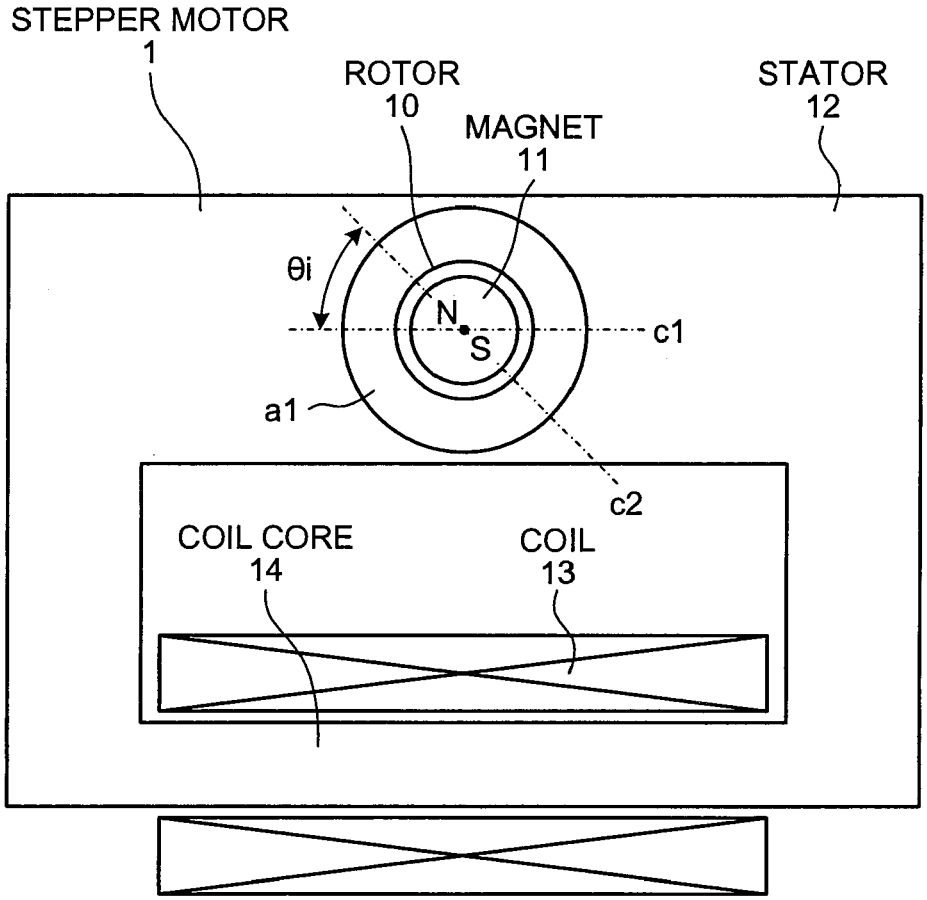
FIG. 23 is a planar view of a stepper motor, for explaining operation of a rotor 10.
Figure 24:
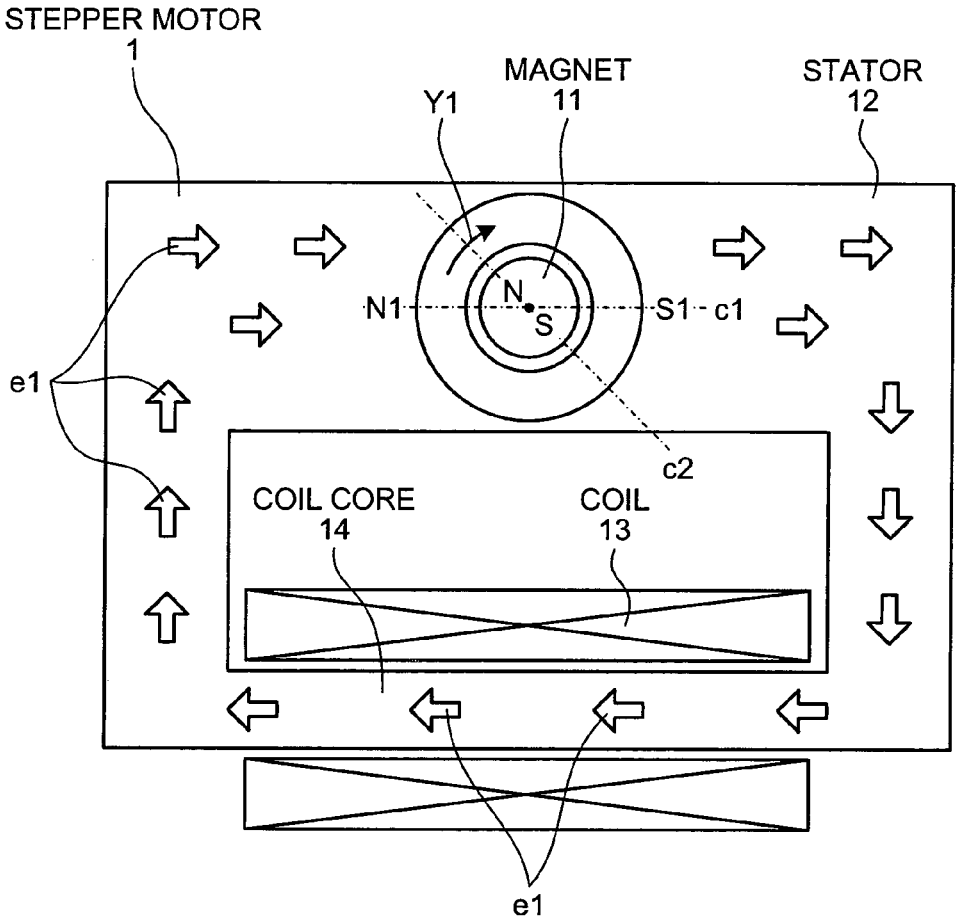
FIG. 24 is a planar view of the stepper motor, for explaining operation of the rotor 10.
Figure 25:
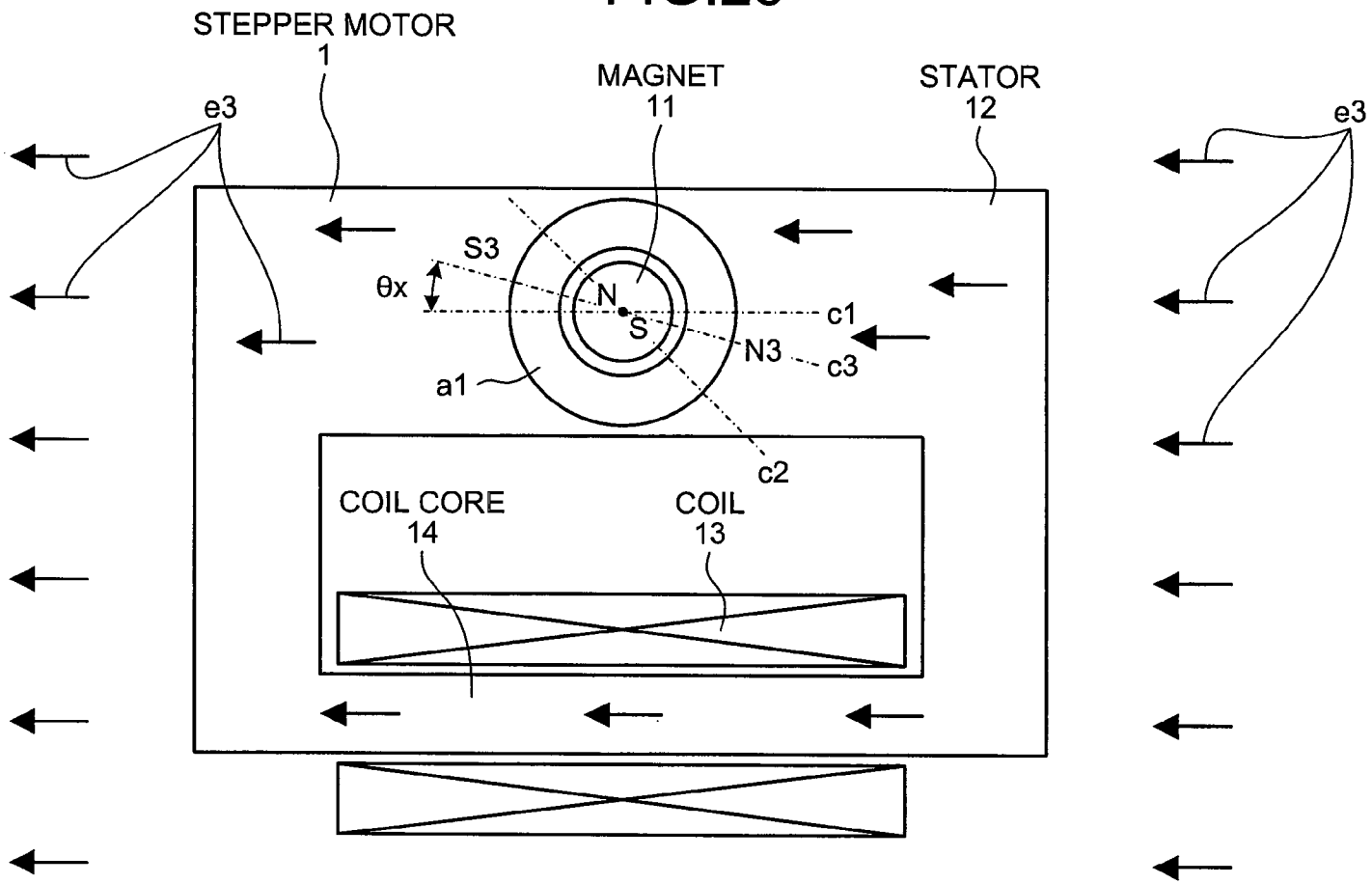
FIG. 25 is a planar view of the stepper motor, for explaining operation of the rotor 10.
Figure 26:
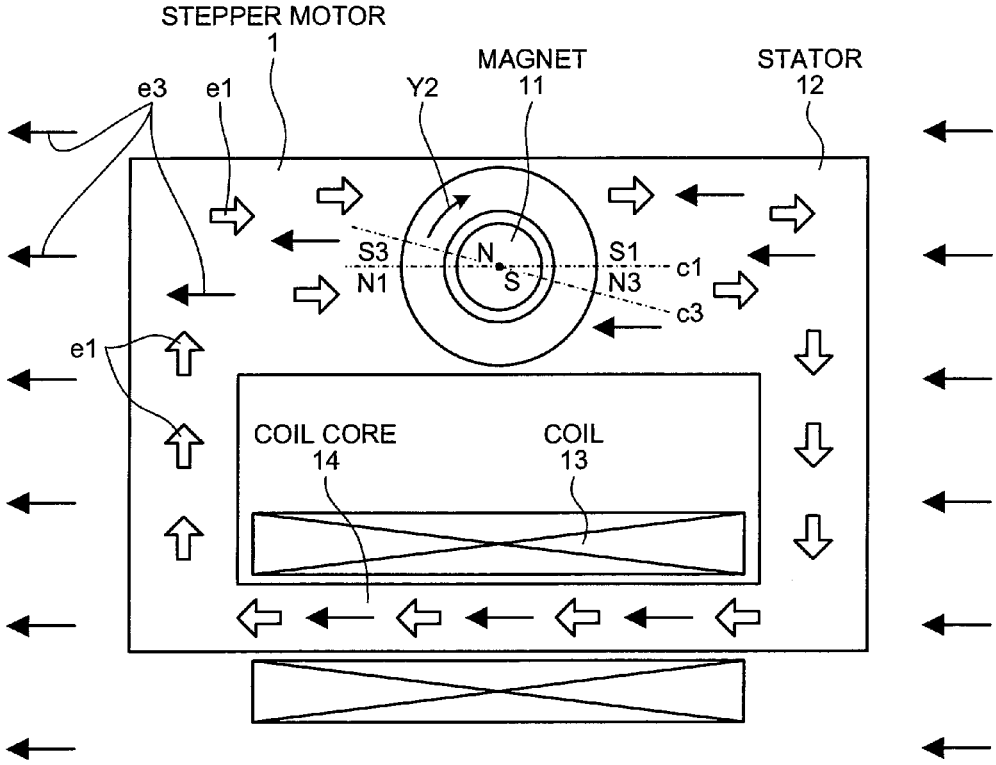
FIG. 26 is a planar view of the stepper motor, for explaining operation of the rotor 10.
Figure 27:
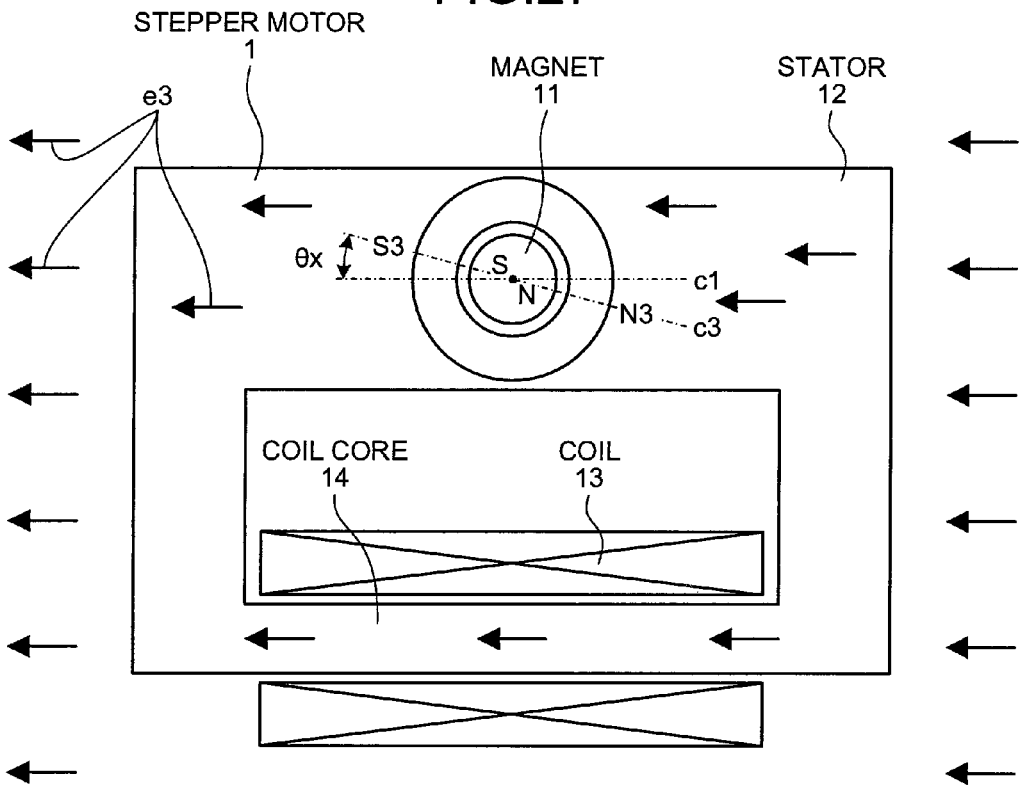
FIG. 27 is a planar view of the stepper motor, for explaining operation of the rotor 10.
Figure 28:
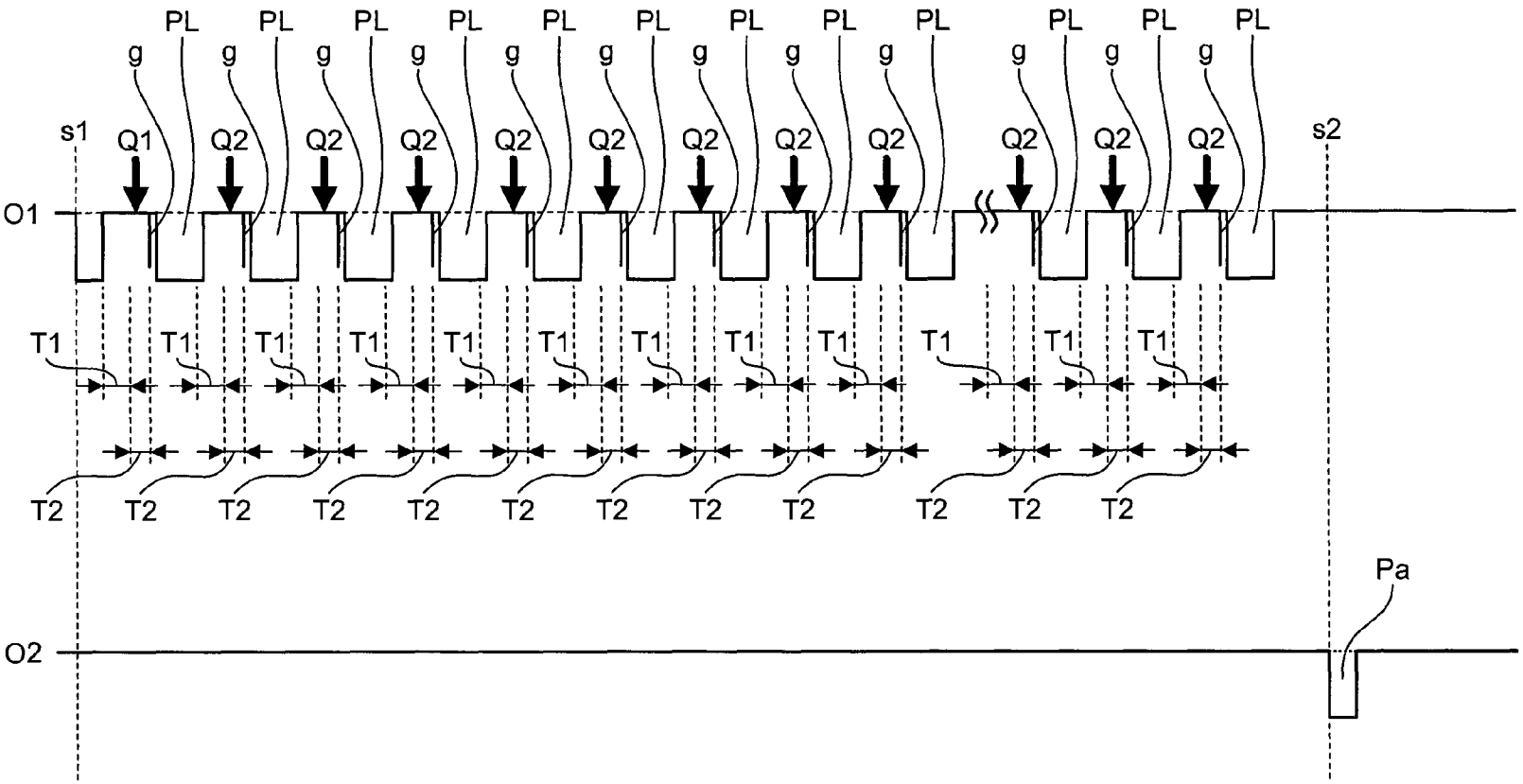
FIG. 28 is a wave diagram for explaining errant hand operation of the conventional electronic timepiece.

FIG. 19 is a flowchart of the processes of the electronic timepiece according to the sixth embodiment. Concerning details of the processes of the electronic timepiece having the chronograph function, FIG. 19 depicts details of the processes for the results of the rotation detection of the rotation detecting circuit of the chrono-motor 1101 and has the same content as that of FIG. 16, and will not again be described. FIG. 20 is a flowchart of the processes of the electronic timepiece having the chronograph function. Concerning details of the processes of the electronic timepiece having the chronograph function, FIG. 20 depicts details of the processes for the results of the rotation detection of the rotation detecting circuit of the current-time motor and includes details of processes that are common to FIG. 20 and FIG. 17, and therefore, only details of the processes that are different from those of FIG. 17 will be described.

As depicted in FIG. 20, if the operation state of the chronograph by the chronograph control circuit 1102 is being stopped (step S1701: YES) and the result of the rotation detection of the rotation detecting circuit 115*b* of the current-time motor 1 is "non-rotation" (step S1702: NO), the limiting circuit 116 prohibits the detecting operation of the impact detecting circuit 114 (step S2004) and the series of processes comes to an end.

As described, according to the electronic timepieces of the fifth and the sixth embodiments, the operation is controlled of the limitation on the output of the locking pulse to the second motor (chrono-motor 1101) that operates intermittently or at long intervals, based on the result of the rotation detection of the first motor (current-time motor 1) that operates steadily and at short intervals. The electronic timepieces are each configured to use a motor (the current-time motor 1) as an external-magnetic-filed sensor that is different from the motor to which the output of the locking pulse is limited. Thereby, regardless of the operation or non-operation of the second motor (the chrono-motor 1101), the limitation on the output of the locking pulse may be controlled using the intervals for the hand operation interval (one second in the fifth and the sixth embodiments) of the first motor. Therefore, regardless of the state of the second motor, the operation of limiting the output of the locking pulse is controlled steadily and at short intervals. Therefore, degradation may be prevented of the braking function of the motors due to a long continuation of the state where the output of the locking pulse is limited.

According to the electronic timepieces of the fifth and the sixth embodiments, even when the second motor is a motor that operates its hand at time intervals of, for example, two seconds, four seconds, five seconds, 10 seconds, 15 seconds, 20 seconds, 30 seconds, one minute, two minutes, and 12 minutes, the limitation of the output of the locking pulse may be controlled every one second.

As described, according to the present invention, the errant hand operation in a magnetic field may be prevented for an electronic timepiece that employs the electromagnetic braking scheme. According to the second and the third embodiments, the present invention may further be employed in an electronic timepiece using the multi-stage load correction and therefore, a low-current-consumption and impact-resistant electronic timepiece may be provided. According to the fourth to the sixth embodiments, the prohibition and the permission of the output of the locking pulse PL may also be properly controlled in an electronic timepiece that is configured to arbitrarily start and stop the operation of its hand like a chrono-hand.

The invention claimed is:

1. An electronic timepiece comprising:

a stepper motor that has a coil and a rotor;

an ordinary-driving-pulse generating unit that drives the stepper motor;

a rotation detecting unit that detects rotation and non-rotation of the rotor;

a correction-driving-pulse generating unit that generates a correction driving pulse if the rotation detecting unit determines the non-rotation, based on a detection result;

an impact detecting unit that detects a vibration of the rotor, the vibration generated by external impact; and a locking pulse output unit that outputs a locking pulse, the locking pulse braking and controlling the stepper motor if the impact detecting unit detects the impact, wherein the electronic timepiece further comprises an impact detection control unit that prohibits the detecting operation of the impact detecting unit when the non-rotation is detected, and permits the detecting operation of the impact detecting unit when the rotation is detected.

2. The electronic timepiece of claim 1, wherein the impact detection control unit, if the correction driving pulse is output successively, continues the impact detection when the correction driving pulse is output for a first time, and prohibits the impact detection when the correction the driving pulse is output for a second time and each successive time thereafter.

3. The electronic timepiece of claim 1, wherein the ordinary-driving-pulse generating unit comprises an ordinary-driving-pulse selecting unit that generates a plurality of ordinary driving pulses having different magnitudes of driving power, that selects one ordinary driving pulse from the plurality of ordinary driving pulses, and that outputs the selected ordinary driving pulse, and the impact detection control unit continues the impact detection by the impact detecting unit when the correction driving pulse is output for a first time after the ordinary-driving-pulse selecting unit switches from the selected ordinary driving pulse to an ordinary driving pulse that is smaller than the selected ordinary driving pulse, and prohibits the impact detection when the correction driving pulse is output for a second time and each successive time thereafter.

4. The electronic timepiece of claim 1, wherein the impact detection control unit permits the impact detecting unit to execute the detecting operation when a predetermined time period has elapsed after the detecting operation of the impact detecting unit is prohibited when the non-rotation is detected.

5. The electronic timepiece of claim 4, further comprising a driving pulse control unit that controls permission and stopping of the output of the ordinary driving pulse using the ordinary-driving-pulse generating unit, based on detection of a second predetermined condition, wherein the detecting operation of the impact detecting unit is permitted after the predetermined time period has elapsed since the stopping of the output of the ordinary driving pulse, by the driving pulse control unit.

6. The electronic timepiece of claim 4, further comprising:

a second stepper motor that has a coil and a rotor;

a second ordinary-driving-pulse generating unit that drives the second stepper motor;

a second rotation detecting unit that detects rotation and non-rotation of the rotor of the second stepper motor; and a second correction-driving-pulse generating unit that generates the correction driving pulse if the second rotation detecting unit determines the non-rotation, based on a detection result, wherein the impact detection control unit permits the detecting operation of the impact detecting unit when the rotation is detected by the second rotation detecting unit.

7. The electronic timepiece of claim 6, wherein the impact detection control unit prohibits the detecting operation of the impact detecting unit when the non-rotation is detected by the second rotation detecting unit.

8. The electronic timepiece of claim 6, wherein a longitudinal direction of the coil of the stepper motor and that of the second stepper motor are disposed parallel to each other.

9. The electronic timepiece of claim 1, wherein if the impact detection is prohibited, terminals of the coil are shunted.

* * * * *